US010709959B1

(12) United States Patent
Chung

(10) Patent No.: US 10,709,959 B1
(45) Date of Patent: Jul. 14, 2020

(54) BOARD SPORT LEARNING KNEEBOARD

(71) Applicant: Rasyad Chung, Berkeley, CA (US)

(72) Inventor: Rasyad Chung, Berkeley, CA (US)

( * ) Notice: Subject to any disclaimer, the term of this patent is extended or adjusted under 35 U.S.C. 154(b) by 0 days.

(21) Appl. No.: 16/396,406

(22) Filed: Apr. 26, 2019

Related U.S. Application Data

(60) Provisional application No. 62/665,412, filed on May 1, 2018.

(51) Int. Cl.
*A63C 17/01* (2006.01)
*A63C 17/26* (2006.01)
*A63B 69/00* (2006.01)

(52) U.S. Cl.
CPC ..... *A63C 17/012* (2013.01); *A63C 17/265* (2013.01); *A63B 69/0093* (2013.01); *A63C 17/015* (2013.01)

(58) Field of Classification Search
CPC ... A63C 17/012; A63C 17/011; A63C 17/265; A63C 17/015; A63B 69/0093
USPC ..... 280/87.042
See application file for complete search history.

(56) References Cited

U.S. PATENT DOCUMENTS 5,879,013 A * 3/1999 Shih ..... A63C 17/01 280/11.28
6,182,987 B1 2/2001 Bryant
6,224,076 B1 5/2001 Kent
6,474,666 B1 11/2002 Andersen et al.
6,520,517 B1 2/2003 Chung et al.
6,793,224 B2 9/2004 Stratton
7,044,485 B2 5/2006 Kent et al.
7,104,558 B1 9/2006 Saldana
8,579,300 B2 11/2013 Fraley
8,800,935 B2 8/2014 Francis
9,145,030 B2 * 9/2015 Williams ..... B60B 35/025
9,821,215 B2 11/2017 Ivazes
9,901,807 B2 2/2018 Su
10,160,507 B2 12/2018 Chung
10,265,606 B1 * 4/2019 Chung ..... A63C 17/0046
10,617,936 B2 * 4/2020 Koch ..... A63C 17/012
2004/0145142 A1 7/2004 Wang
2005/0167938 A1 8/2005 Chung
2011/0316245 A1 12/2011 Burke
2014/0027989 A1 1/2014 Baumann

* cited by examiner

*Primary Examiner* — John D Walters
(74) *Attorney, Agent, or Firm* — Adams Law Office; Sharon Adams

(57) ABSTRACT

A riding device with a front truck and a rear truck connected by a frame, with a longitudinal roll axis coincident with a virtual line between a front virtual pivot point and a rear virtual pivot point. Each virtual pivot point is located at the intersection of a line projecting upward from the central point of a hanger axle axis and a hanger pivot axis. Virtual pivot points are the points about which the front and rear hanger pivot axis rotate as a result of rider input leaning to the right or left.

15 Claims, 17 Drawing Sheets

BOARD SPORT LEARNING KNEEBOARD

CROSS-REFERENCE TO RELATED APPLICATION

This application claims the benefit of U.S. provisional application No. 62/665,412, filed May 1, 2018, entitled Board Sport Learning Kneeboard, and naming Rasyad Chung as the inventor, which is hereby incorporated by reference in its entirety.

STATEMENT REGARDING PRIOR DISCLOSURES BY THE INVENTOR OR A JOINT INVENTOR

The following disclosure is submitted: U.S. Pat. No. 10,265,606 issued on Apr. 23, 2019.

BACKGROUND OF THE INVENTION

Board sports like surfing, snowboarding, and skateboarding share similar control and ride dynamics and so require mastery of three fundamental kinds of balance. The first two kinds of balance, side-to-side balance and front-to-back balance are defined here relative to the riding device and direction of travel. Side-to-side balance refers to balance to the right or left side of the direction of travel, and may be referred to as "lean steering". Front-to-back refers to balancing toward or away from the direction of travel. The third kind of basic balance, one foot-two foot balance relates to balancing on one foot or both feet, the transition between one foot and two feet, as well as maintaining balance when changing foot positions on the board.

With board sports a board or deck supports the rider and both steering and side to side balance are controlled by leaning the board right to steer right and left to steer left. A rider in motion falling off the board to the right leans the board to the right to steer the board right and back underneath the rider in order to regain balance. As well, turning requires riders to dynamically project their center of mass to the right or left in advance of lean steering the board. Learning board sport lean steering to maintain side-to side balance going straight or while turning is a significant learning challenge further complicated by the difficulty of mastering front-to-back balance and one foot-two foot balance.

The present invention is a riding device that facilitates learning the three kinds of balance required with board sports.

BRIEF SUMMARY OF THE INVENTION

The present invention is a lean steering riding device preferably for use by children, although any person may use the device. As shown in FIG. 6, the invention is comprised of a frame and deck assembly 2 with a hand rail, a front lean steering truck assembly 4 connected with two wheels, a rear lean steering truck assembly 5 connected with two wheels, and a detachable push/pull handle assembly 3. In use the rider may kneel on the deck and hold onto the handrail with one or both hands leaning right to turn right and leaning left to turn left. In a preferred embodiment, a detachable push/pull handle is provided for a parent or other responsible person (herein called "parent") to provide propulsion, assist with steering, and control speed. This handle can additionally provide feedback to the parent about the child's skill level and the accuracy of their lean steering inputs, creating an interactive experience.

The present invention provides devices and methods for children, or others, to learn the basics of side-to-side balance, lean steering, and one foot-two foot balance in a safe and fun manner. The rider first may practice and learn side-to-side balance and lean steering by using the device with both knees on the deck with propulsion provided by a parent or other responsible adult via the push/pull handle. As the child masters the basics of lean steering, the push/pull handle may be removed and the child may ride independently.

In this way, the rider may first learn left-right balance and lean steering without having to focus on the challenges of front-to-back balance or one foot-two foot balance. After mastering this skill, the rider may then confidently learn front-to-back balance and one foot-two foot balance. One foot-two foot balance is preferably learned by detaching the push/pull handle allowing the rider independent control of propulsion. The handrail provides front-to-back stability so the rider can practice one foot-two foot balance while kneeling with one knee on the deck and pushing on the ground with the other foot for propulsion or braking.

When kneeling on the deck with both knees rolling straight or when turning the rider can experiment with letting go of the handrail with one or both hands and balancing without holding on to practice front-to-back balance and develop more advanced side-to-side balance and lean steering skill.

One foot-two foot balance is preferably learned by detaching the push/pull handle allowing the rider independent control of propulsion The handrail provides front-to-back stability so the rider can practice one foot-two foot balance while kneeling with one knee on the deck and pushing on the ground with the other foot for propulsion or braking.

In some embodiments, the invention described herein comprises a front hanger and a rear hanger attached to a deck, wherein each hanger has two parallel kingpins such that each kingpin is surrounded by an elastomeric component where the bottom surface of each bushing rests on the hanger projection and the top surface is in contact with a baseblock. In other embodiments, kingpins are replaced by u-bolts or straps that connect the hanger and baseblock with the elastomeric components sandwiched between the hanger and baseblock.

In all embodiments the elastomeric components support opposing surfaces of a hanger and baseblock and provide a return to center spring force.

In preferred embodiments, the deck is at or below a longitudinal roll axis thus providing a pendulum like stability. In some embodiments, the deck and frame may be a single unit.

In some embodiments, each truck has a first rigid body comprised of a hanger assembly with two kingpins, where the top of each kingpin is connected with either a cylindrical bearing, a hemispheric bearing, or a spherical bearing. A second rigid body is comprised of a baseblock connected with the frame of the riding device. In these embodiments, the cylindrical bearing, hemispheric bearings, or spherical bearings are moveably secured within the baseblock and the movement of these bearings forms a revolute joint that is coincident with a hanger pivot axis. A virtual pivot point is located at the intersection of a line projecting upward from a central point of each truck's hanger axle axis and the hanger pivot axis. A longitudinal roll axis runs between the front and rear virtual pivot points.

In other embodiments, each truck has a first rigid body comprised of a hanger assembly connected by a revolute joint to the second rigid body. The revolute joint is formed by u-connectors. The second rigid body is comprised of a base-bushings connected with the frame of the riding device. In these embodiments, the u-connectors are moveably secured to the base-bushings and the movement of these u-connectors forms a revolute joint that is coincident with a hanger pivot axis. A virtual pivot point is located at the intersection of a line projecting upward from a central point of each truck's hanger axle axis and the hanger pivot axis. A longitudinal roll axis runs between the front and rear virtual pivot points.

DETAILED DESCRIPTION OF THE PRESENT INVENTION

Figure 1:
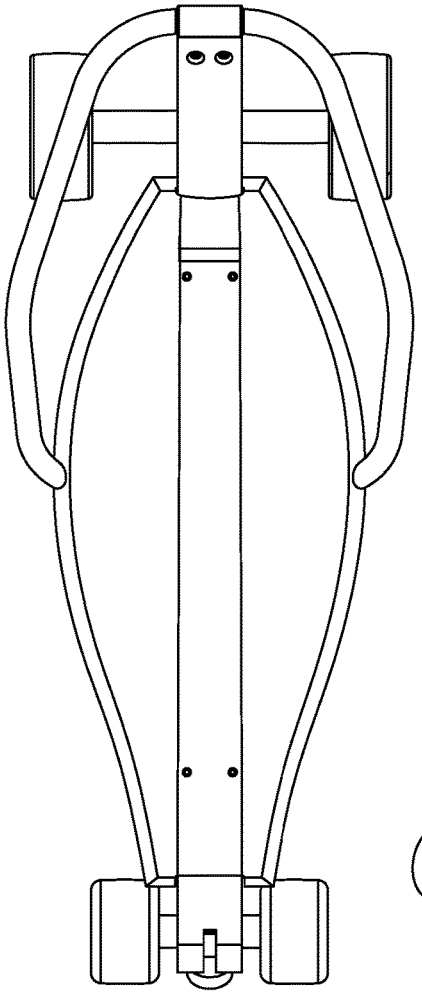
FIG. 1 is a plan view of a first embodiment of present invention with handle detached.
Figure 2:
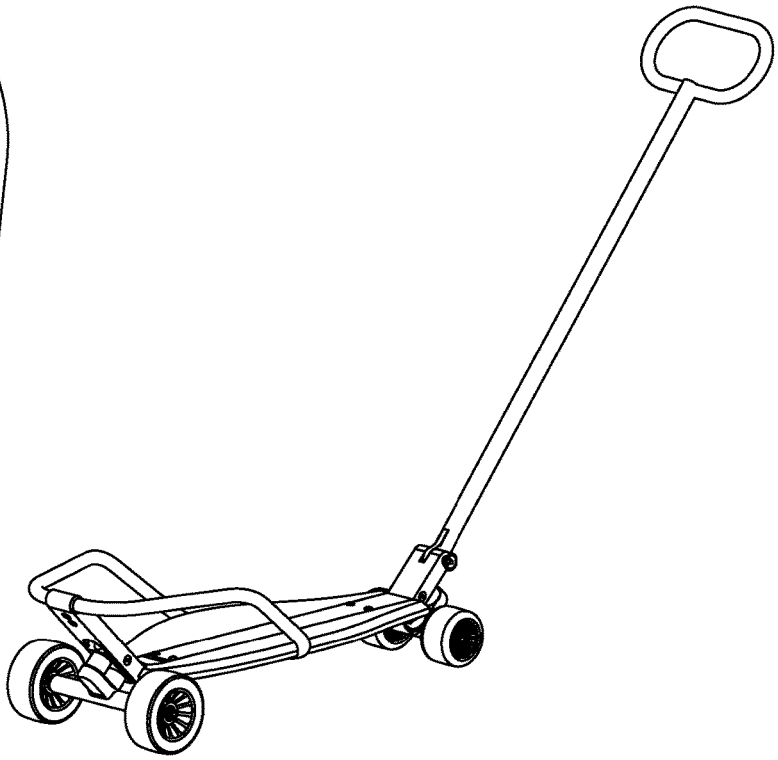
FIG. 2 is a perspective view of the first embodiment with handle attached.
Figure 3:
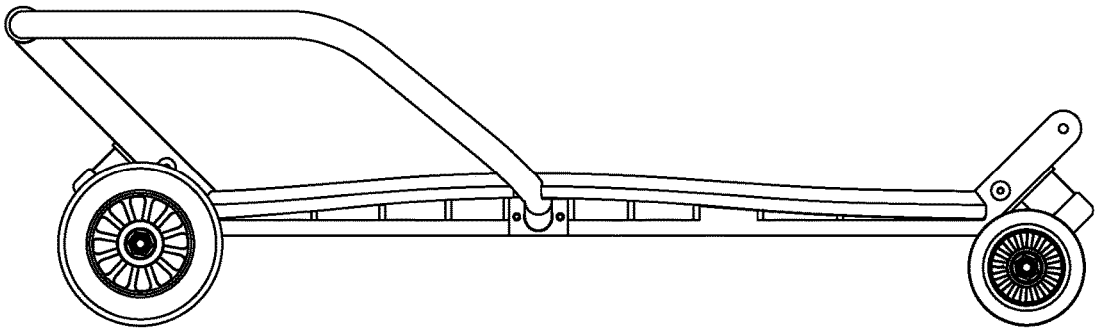
FIG. 3 is a side view of the first embodiment with handle detached.

Specific exemplary embodiments of the invention are illustrated in the figures and described herein. However, the invention may be embodied in many different forms and should not be construed as limited to these exemplary embodiments. Unless specifically noted, articles depicted in the drawings are not necessarily drawn to scale.

It will be understood that although the terms "first" and "second" are used herein to describe various elements, these elements should not be limited by these terms. These terms are used only to distinguish one element from another element.

The lean-steering mechanism of skateboards, skates, scooters, and the like is commonly referred to as the "truck-assembly", or simply a "truck". A truck typically comprises two rigid bodies generally referred to as a base-plate, called herein baseblock and hanger. With the present invention, the baseblock 500 is mounted within a frame and the hanger 400 supports two laterally spaced wheels that roll on the ground. The rigid bodies of baseblock and hanger are kinematically linked so as to allow rotation relative to each other about a common axis, called here the hanger pivot axis 20.

In some embodiments the present invention has a first rigid body, a second rigid body, and elastomeric components. The first rigid body generally comprises a hanger assembly and kingpins connected with either a cylindrical bearing, hemispheric bearings, or spherical bearings. The second rigid body generally comprises a baseblock connected with the frame. When the present invention is assembled and in use the front baseblock, the rear baseblock, the frame assembly 200, deck assembly 220, and handrail assembly 230 form a single rigid body, referred to herein as the second rigid body. It is not necessary to separate these assemblies, and in some embodiments the assemblies may be a single unit, as non-limiting examples, by combining the frame assembly and deck assembly to form a single unit, or by combining the frame assembly and the handrail assembly. The front and rear wheels are constrained by the plane of the ground and support the axles of the front and rear hangers. A front cylindrical bearing 411 is within the front baseblock and a front revolute joint connects the front hanger with the front baseblock, and a rear revolute joint connects the rear hanger with the rear baseblock. The revolute joints concentrically define the front and rear hanger pivot axes 20, shown in FIG. 4. In use, rider input leaning left causes the deck and frame assembly and the front and rear hanger pivot axes to lean to the left. Constrained by the plane of ground the wheels and hanger of the front truck are forced to rotate about the front hanger pivot axis while simultaneously the wheels and hanger of the rear truck are forced to rotate about the rear hanger pivot axis which results in steering of the wheels to the left. Likewise, leaning right causes the wheels to steer right.

Figure 4:
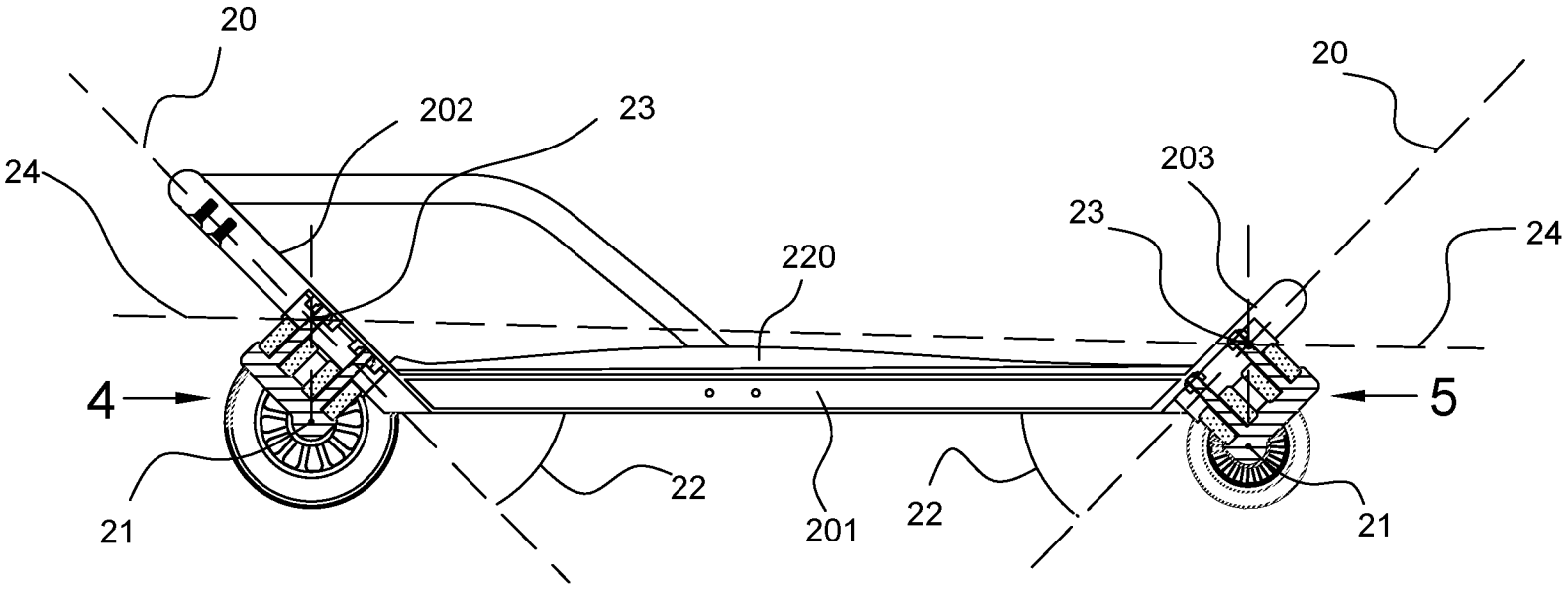
FIG. 4 is a side sectional view of the first embodiment showing virtual pivot points and axes of rotation.

FIG. 4 shows a side section view of the present invention with push-pull handle detached. Front truck 4 is shown mounted within front angle frame member 202 and rear truck 5 is shown mounted within rear frame member 203.

With the present invention the hanger pivot axis angles 22 of the front and rear hanger pivot axes 20 of the front and rear trucks 4 and 5 are defined by the angles of front and rear frame members 202 and 203 relative to central frame member 201. The front hanger pivot axis angle 22 is coincident with the angle of front frame member 202 relative to central frame member 201. The rear hanger pivot axis angle 22 is coincident with the angle of rear frame member 203 relative to central frame member 201.

As shown in FIG. 4, virtual pivot points 23 exist at the intersection of a line projecting upward from the central point of the hanger axle axis 21 that intersects the hanger pivot axis 20. Virtual pivot points are the points about which the front and rear hanger pivot axis rotate as a result of rider input leaning to the right or left.

Figure 5:
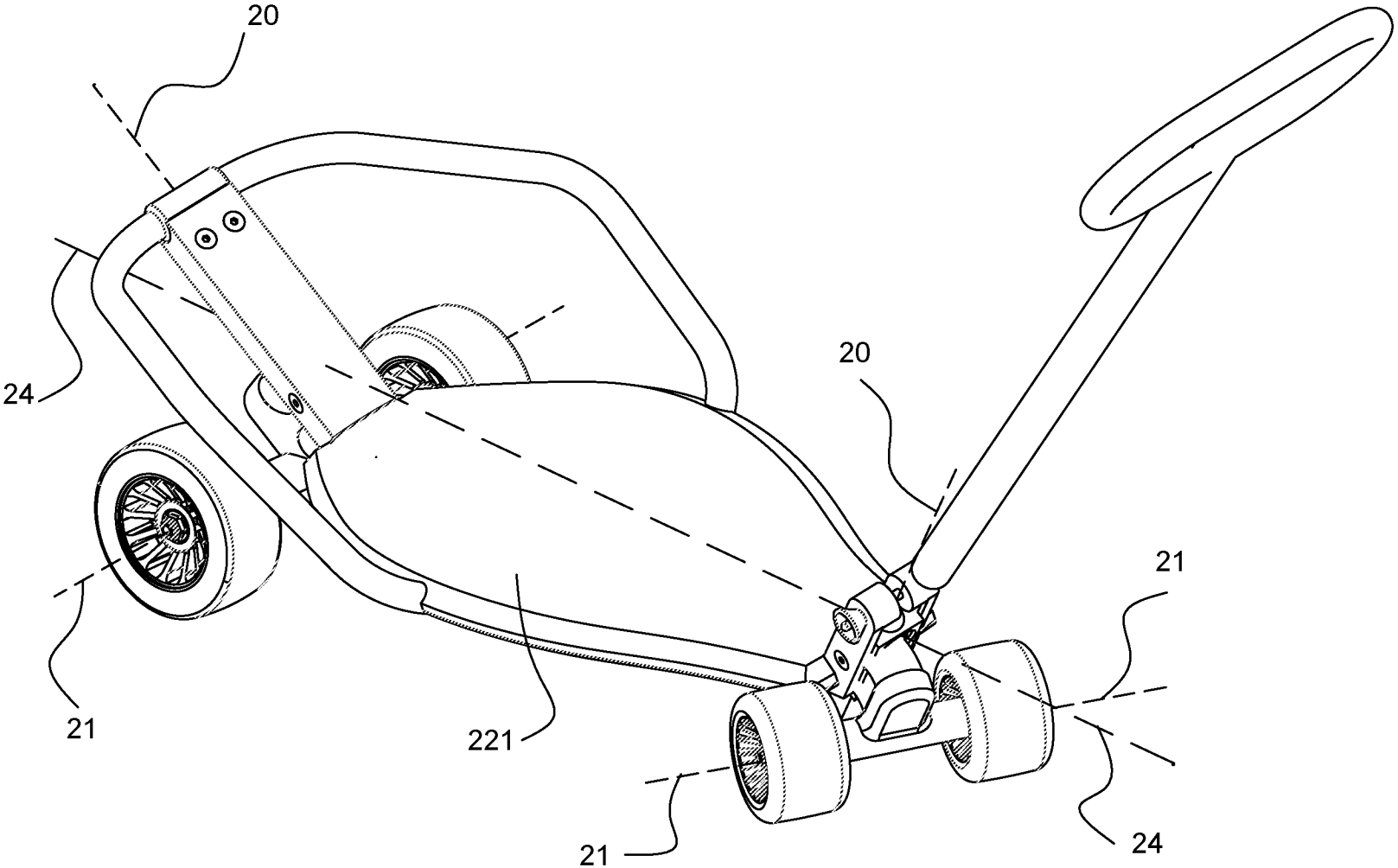
FIG. 5 is rear perspective view of the first embodiment leaned to the left 20 degrees with front and rear truck steering to the left.

A longitudinal roll axis 24 is defined by and coincident with a virtual line that runs between the front and rear virtual pivot points 23, as shown in FIGS. 4 and 5.

FIGS. 4 and 5 show frame 201 and deck 220 below the longitudinal roll axis 24. As shown in FIG. 5, in this configuration, leaning the invention side to side results in a pendulum motion of the deck relative to the longitudinal roll axis which in turn produces a natural leveling tendency when supporting the mass of the rider kneeling or sitting on deck surface 221. This configuration assists in learning side-to-side balance and lean-steering.

Figure 6:
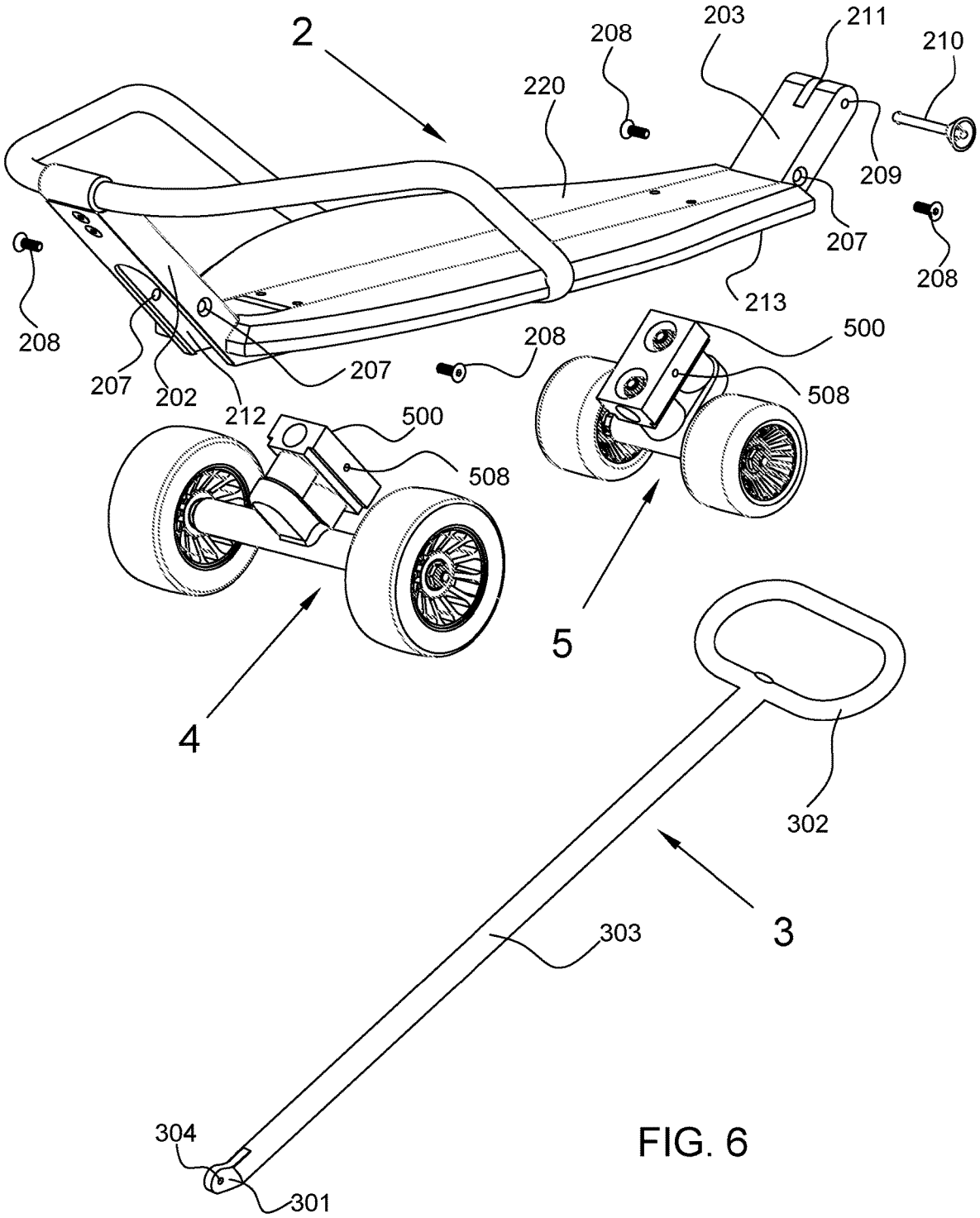
FIG. 6 is a perspective view of the first embodiment showing major assemblies.

FIG. 6 shows the major assemblies of the present invention: deck, frame and handrail assembly 2; handle assembly 3; front truck assembly 4 and rear truck assembly 5. As shown in FIG. 6, front angle frame member 202 has cavity 212 for mounting front truck assembly 4. Rear angle frame member 203 has cavity 213 for mounting rear truck assembly 5. Internal cavities 212 and 213 of front and rear angle frame members 202 and 203 respectively are sized to receive and constrain mounting baseblocks 500. In a preferred embodiment, four cross bore holes 207 in frame members 202 and 203 and hole 508 in baseblock 500 accept screws 208 to secure the baseblocks 500. In other embodiments baseblocks 500 may be connected with frame by any means known in the art.

Handle assembly 3 comprises tang 301, handgrip 302 and shaft 303. In a preferred embodiment slot 211 of rear frame angle member 203 is capable of receiving and constraining the side surfaces of tang 301 of detachable push/pull handle assembly 3 to rear angle frame member 203. Quick release pin 210 passes through cross-bore 209 of rear angle frame 203 and through tang cross-bore 304 to removeably fix in place handle assembly 3. In other embodiments handle assembly 3 may be removeably connected using any means known in the art. Handle assembly 3 is connected with the rear frame angle member by a joint that allows handle assembly 3 to rotate forward over deck 220 for compact transportation as well as rotating up or down when pushing or pulling, in this way adjusting to different height parents and various parent hand positions. Handle grip 302 may be configured to allow multiple hand positions.

Figure 7:
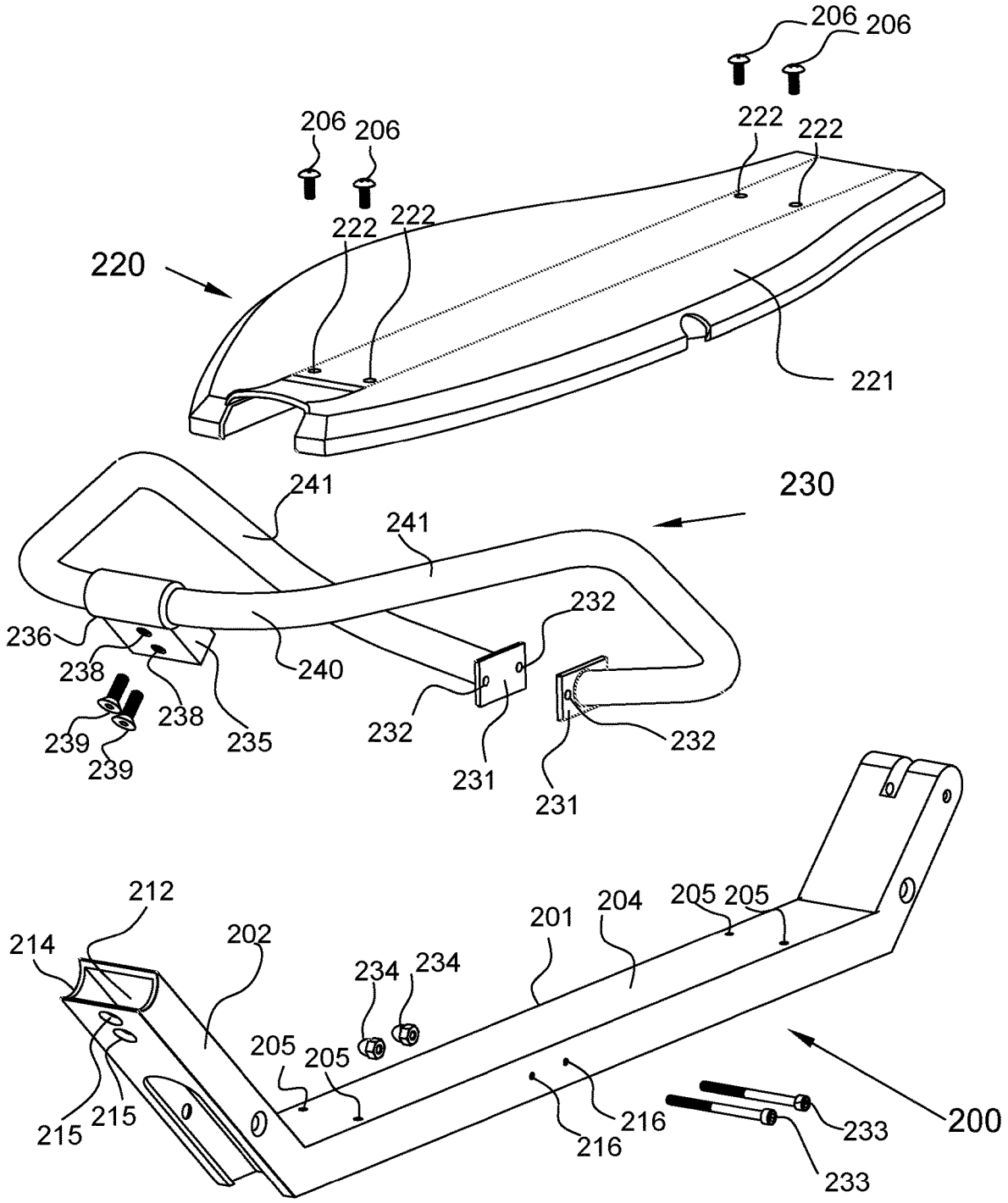
FIG. 7 is an exploded perspective view of deck, frame, and handrail of the first embodiment.

FIG. 7 shows frame 200, deck 220, and handrail 230. The handrail is comprised of front grasping surface 240 and left side grasping surface 241 and a right side grasping surface 241. Handrail assembly 230 is connected with the frame, as shown in FIG. 6. In a preferred embodiment profile 235 on the front of handrail 230 fits within the top of cavity 212 of front angle frame member 202 and curved surface 236 mates with a corresponding curved surface 214 on front angle frame member 202. In a preferred embodiment, profile 235 is secured with screws 239 which pass through bores 215 of frame member 202 and thread into holes 238 in profile 235. One handrail mounting plate 231 is located at each end of the handrail, and each mounting plate 231 is connected with center frame member 201. In a preferred embodiment, handrail mounting bolts 233 pass through holes 216 in frame 201 and holes 232 in the mounting plates and are secured by nuts 234. Other means known in the art may be used to connect the handrail to the frame.

Frame assembly 200 has center frame member 201 with top surface 204 that supports deck 220. In a preferred embodiment, four deck mounting screws 206 pass through holes 222 in the deck and thread into threaded holes 205. Deck 220 may have a soft top surface 221 to support and cushion the rider.

Figure 8:
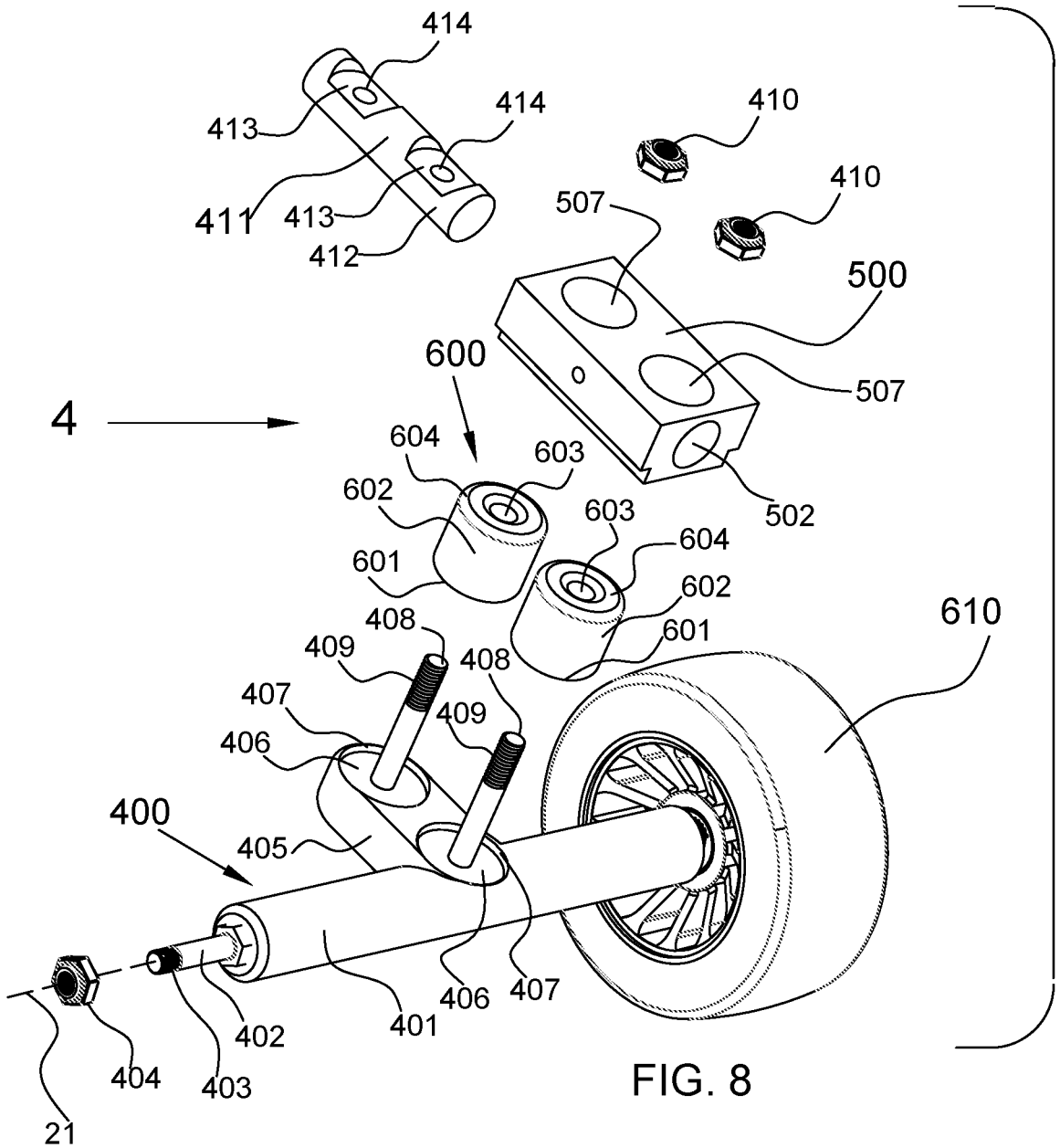
FIG. 8 is an exploded perspective view of assembly 4, showing a first embodiment of the front truck.
Figure 9:
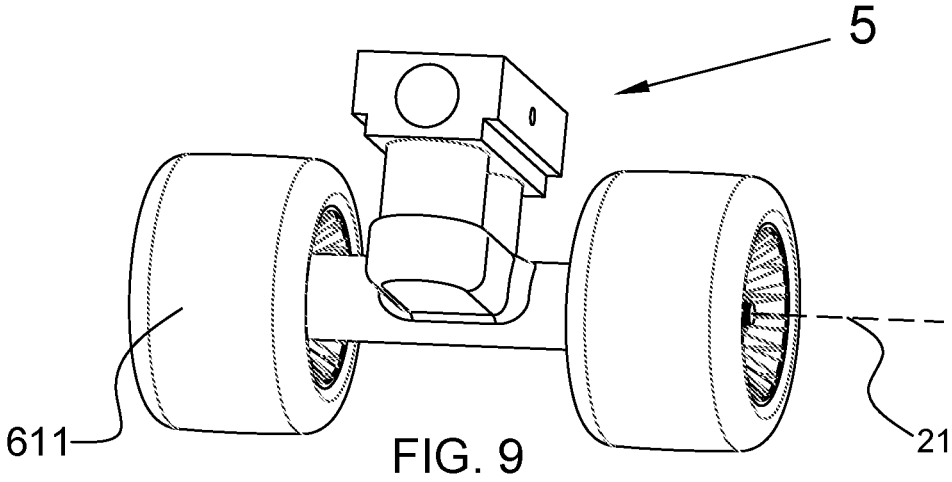
FIG. 9 is an assembled perspective view of assembly 5, showing a first embodiment of the rear truck.
Figure 10:
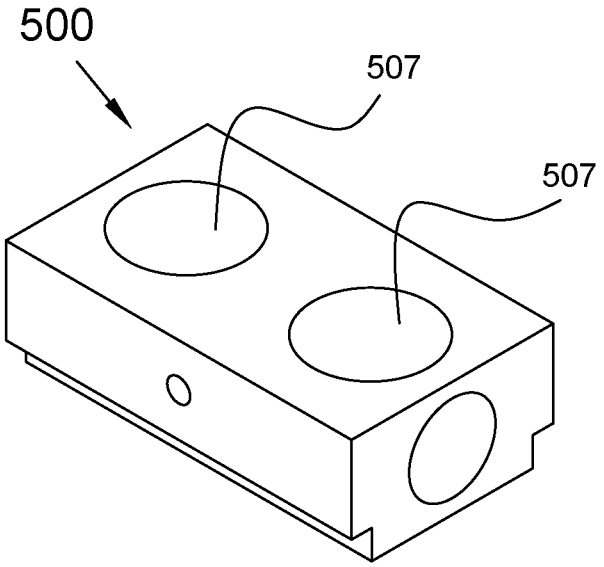
FIG. 10 is a top perspective view of baseblock 500.
Figure 12:
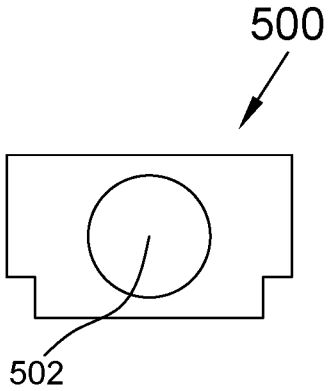
FIG. 12 is a front elevational view of baseblock 500.
Figure 11:
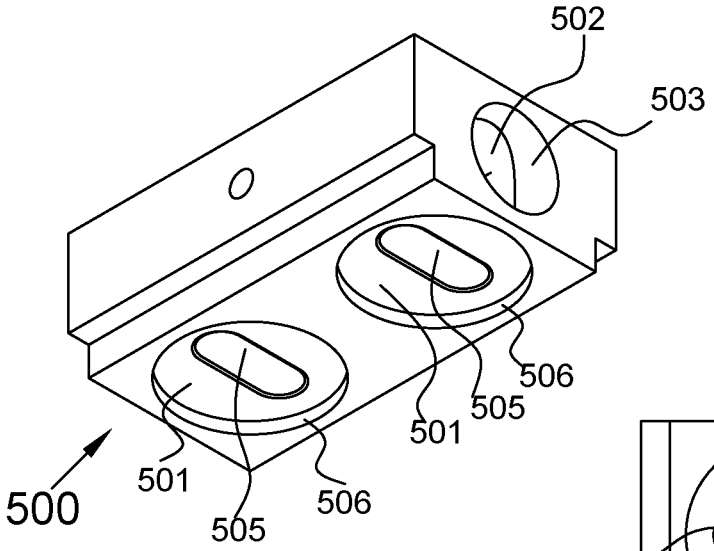
FIG. 11 is a bottom perspective view of baseblock 500.
Figure 13:
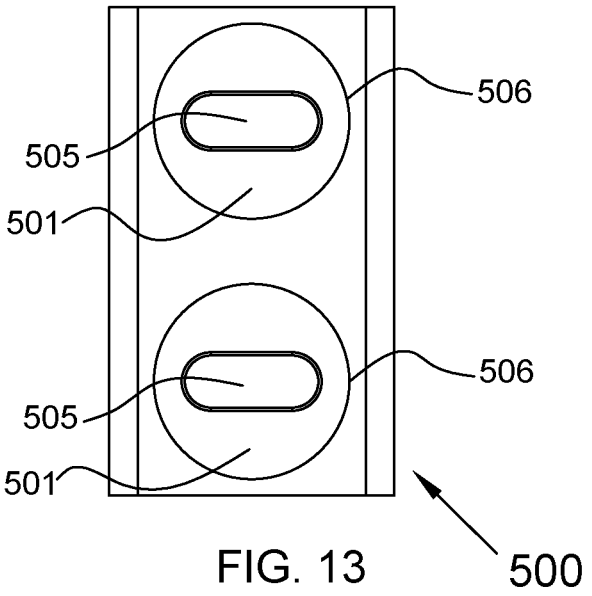
FIG. 13 is a bottom view of baseblock 500.

FIG. 8 shows a first embodiment of front truck assembly 4. FIG. 9 shows a first embodiment of rear truck assembly 5. In a preferred embodiment the front and rear truck assemblies are the same, except for the axle length and wheel size. Front horizontal member 401 and front axle 402 are longer in the front truck than in the rear horizontal member 401 and rear axle 402 in the rear truck. In other embodiment, the front and rear axle length may be the same and in other embodiments the front and rear wheel size may be the same.

The front truck has wheels 610 that are larger than wheels 611 on the rear truck. Front truck assembly 4 is comprised of a hanger assembly 400, cylindrical bearing 411, baseblock 500, and elastomeric bushings 600. In this embodiment, the first rigid body is comprised of the hanger assembly and cylindrical bearing, and the second rigid body is comprised of the baseblock. Cylindrical bearing 411 is contained within baseblock 500. The cylindrical bearing 411 is comprised of a cylindrical surface 412 defining a length, a first pass through bore 414 positioned within a first flat surface 413, and a second pass through bore 414 positioned within a second flat surface 413.

A first elastomeric bushing 600 and a second elastomeric bushing 600 are sandwiched between hanger 400 and baseblock 500 and provide a return to center force in use. Each elastomeric bushing 600 is comprised of a top surface 604, an outside surface 602, a bottom surface 601, and a bushing bore 603 that runs between the top surface and the bottom surface.

Front hanger assembly 400 is comprised of horizontal member 401 that surrounds axle 402 and projecting member 405. One wheel 610 mounts to each end of axle 402 and is secured by nut 404 to threads 403. Two integrated kingpins 408 protrude from projecting member 405.

Baseblock 500 is further detailed in FIGS. 10-13. Baseblock 500 has a top surface, bottom surface, front surface, back surface, left surface, and right surface. A central bore 502 runs between the front surface and back surface and receives cylindrical bearing 411 such that bearing surface 503 and cylindrical surface 412 form a revolute joint. Two oval bores 505 disposed within the bottom surface of baseblock 500. Each oval bore has a length that is parallel to the front and/or back surface of the baseblock. Each oval bore receives one kingpin 408 and the length of the oval bore defines the rotation of hanger 400 and baseblock 500 relative to each other about the hanger pivot axis 22. Hanger pivot axis 22 is coincident with the central axis of cylindrical bearing 411 and central bore 502 of baseblock 500. At least one, and preferably two access holes 507 on the top allow for installation and adjustment of nuts 410 onto threaded areas 409 at the end of each kingpin 408.

Assembly is as follows. A first bushing bore 603 of a first elastomeric bushing 600 slides onto a first integrated kingpin 408, and a second bushing bore 603 of a second elastomeric bushing 600 slides onto a second integrated kingpin 408. The elastomeric components are received and constrained by projecting member 405. A first recessed area 406 receives and constrains the first elastomeric bushing and a second recessed area 406 the second elastomeric bushing. Each recessed area 406 with side surface 407 of projecting member 405 receives and constrains the bottom surface 601 and lower portion of side surface 602 of each elastomeric component 600.

Cylindrical bearing 411 is positioned within bore 502 of baseblock 500. Each kingpin 408 inserts through one oval bore 505 of base block 500, through one pass through bore 414 of cylindrical bearing 411 and is secured by lock nut 410 that tightens against flat surface 413 of cylindrical bearing 411.

In detail, the first kingpin protrudes from projecting member 405 through the first bushing bore, the first oval bore, the first pass through bore, and into the first access hole where a first nut is threaded onto the threads of the first kingpin. The second kingpin protrudes from projecting member 405 through the second bushing bore, the second oval bore, the second pass through bore, and into the second access hole where a second nut is threaded onto the threads of the second kingpin. In some embodiments, the first and second access hole may be combined as a single larger access hole.

Recessed areas 501 and side surfaces 506 of baseblock 500 receive and constrain top surface 604 and the top portion of the side surface 602 of elastomeric components 600. In detail, a first recessed area 501 with a first side surface 506 receives and constrains a first top surface 604 and first top portion of the side surface 602 of the first elastomeric bushing 600, and a second recessed area 501 with a second side surface 506 receives and constrains a second top surface 604 and second top portion of the side surface 602 of the second elastomeric bushing 600. Tightening or loosening locknuts 410 controls the preload force of elastomeric components 600 of the completed front truck assembly. A first locknut 410 is threaded onto the threads 409 of the first kingpin as it protrudes through the first flat surface 414 of cylindrical bearing 411. First locknut 410 is tightened against first flat surface 414 to control the preload force of elastomeric bushing 600. A second locknut 410 is threaded onto the threads 409 of the second kingpin as it protrudes through the second flat surface 414 of cylindrical bearing 411. Second locknut 410 is tightened against second flat surface 414 to control the preload force of elastomeric bushing 600. Assembly and adjustment of both the front and rear truck assemblies are the same.

Figure 14:
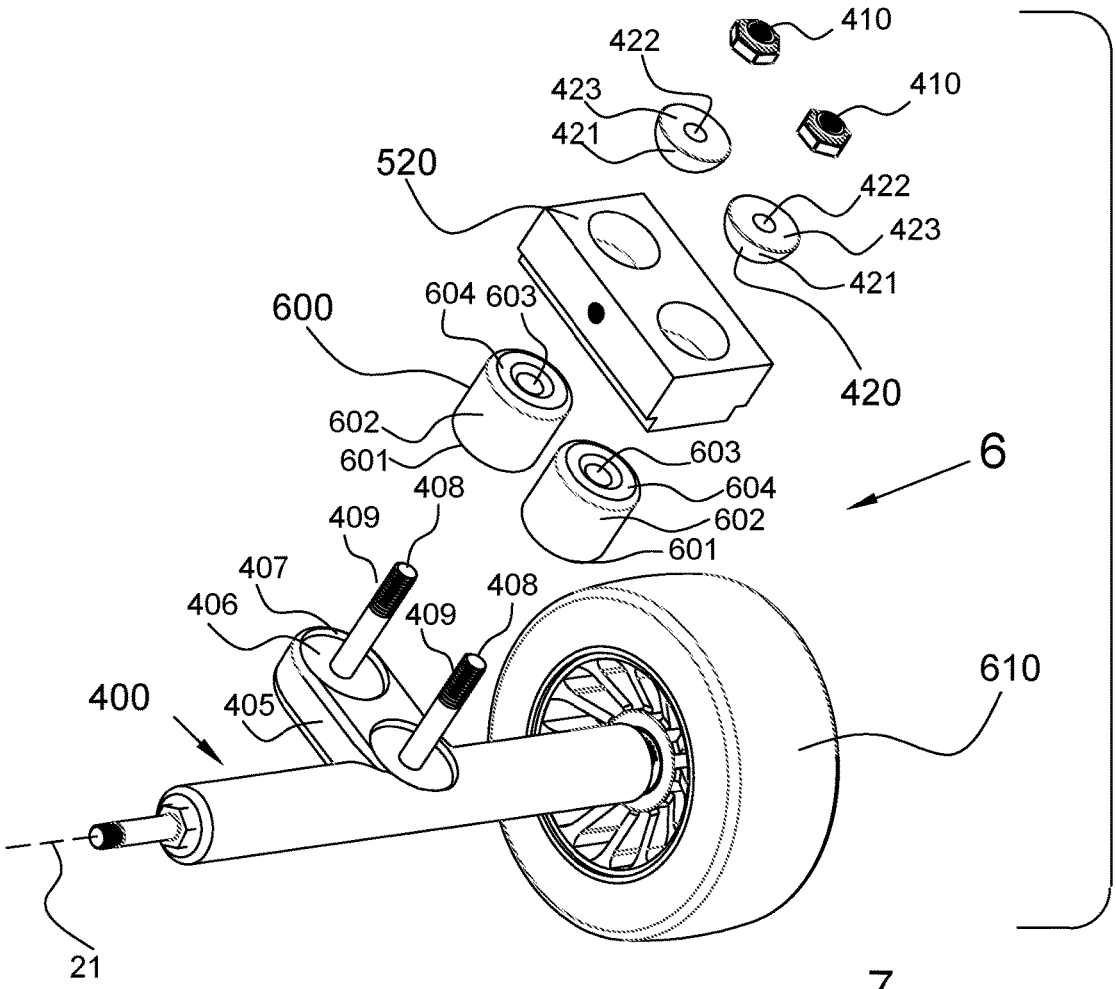
FIG. 14 is an exploded perspective view of assembly 6, showing a second embodiment the front truck.
Figure 15:
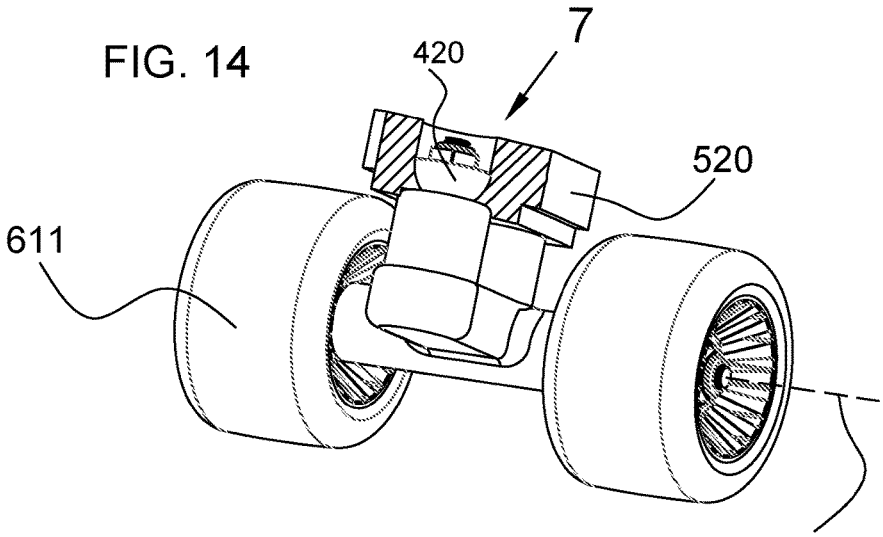
FIG. 15 is an assembled perspective view of assembly 7, showing a second embodiment of the rear truck.

FIG. 14 shows an exploded view of a second embodiment of front truck assembly 6. FIG. 15 shows a second embodiment of rear truck assembly 7 with a partial section of baseblock 520. The second embodiment comprises two hemispherical bearings 420. Similar to the embodiment described above, the front and rear truck assemblies are the same, except for the axle length and wheel size. The front truck axle is longer than the rear truck axle, and the wheels on the front truck are larger than the wheels on the rear truck.

Front truck assembly 6 is comprised of a first rigid body comprising hanger assembly 400, integrated kingpins 408, and hemispherical bearings 420. The second rigid body is comprised of baseblock 520. Front truck assembly 6 is comprised of hanger assembly 400 comprises a first integrated kingpin 408 and a second integrated kingpin 408 on projecting member 405, a first and a second elastomeric component 600, a first and a second wheel 610, a baseblock 520, and a first and a second hemispheric bearing 420.

Base block 520 is further detailed in FIGS. 18-21. Baseblock 520 comprises a first access hole 527 with a first bearing surface 523, and a second access hole 527 with a second bearing surface 523. A first access hole 527 is sized to a receive a first hemispherical bearing 420 with a first hemispheric surface 421 mating with first bearing surface 523 to form a first spherical joint. A second access hole 527 is sized to a receive a second hemispherical bearing 420 with a second hemispheric surface 421 mating with second bearing surface 523 to form a second hemispherical joint. Constrained by baseblock 520 and by integrated kingpins 408 the two spherical joints function as a revolute joint with a single axis of rotation at the hanger pivot axis located at the centroid point of hemispherical components 420.

Assembly of front truck embodiment 6 follows assembly previously described for front truck assembly 4 except that the first kingpin 408 passes through the first access hole 527 of baseblock 520 and through a first corresponding bore 422 of the first hemispherical component 420. A first lock nut 410 threads onto threads 409 of the first kingpin 408 and tightens against first flat surface 423 of the first hemispheric component 420. The second kingpin 408 passes through the second access hole 527 of baseblock 520 and through a second corresponding bore 422 of the second hemispherical component 420. A second lock nut 410 threads onto threads 409 of the second kingpin 408 and tightens against second flat surface 423.

First access hole 527 is disposed within a first recess 521 with a first side surface 526. First elastomeric bushing top surface 604 and a first top portion of side surface 602 are received and constrained by base block 520 first recess 521 and first side surface 526. Second access hole 527 is disposed within a second recess 521 with a second side surface 526. Second elastomeric bushing top surface 604 and a second top portion of side surface 602 are received and constrained by base block 520 second recess 521 and second side surface 526.

A first bore 603 of the first elastomeric component 600 slides onto the first kingpin 408. A second bore 603 of the second elastomeric component 600 slides onto the second kingpin 408. A first recessed area 406 with a first side surface 407 of projecting member 405 receive and constrain the bottom surface 601 and lower portion of side surface 602 of first elastomeric component 600. A second recessed area 406 with a second side surface 407 of projecting member 405 receive and constrain the second bottom surface 601 and second lower portion of side surface 602 of second elastomeric component 600.

A first locknut 410 is threaded onto the first threaded kingpin 408. A second locknut 410 is threaded onto the second threaded kingpin 408. Tightening or loosening locknuts 410 controls the preload force of elastomeric components 600 of the completed front truck assembly. Assembly and adjustment of both the front and rear truck assemblies are the same.

Front truck assembly 6 connect to front angle member 202 and rear truck assembly 7 connects to rear angle member 203 of frame 200 in the same manner as truck assemblies 4 and 5 described previously. One wheel 610 is connected to each end of the axle and hanger 400 in the same manner as described previously for truck assembly 4.

Figure 16:
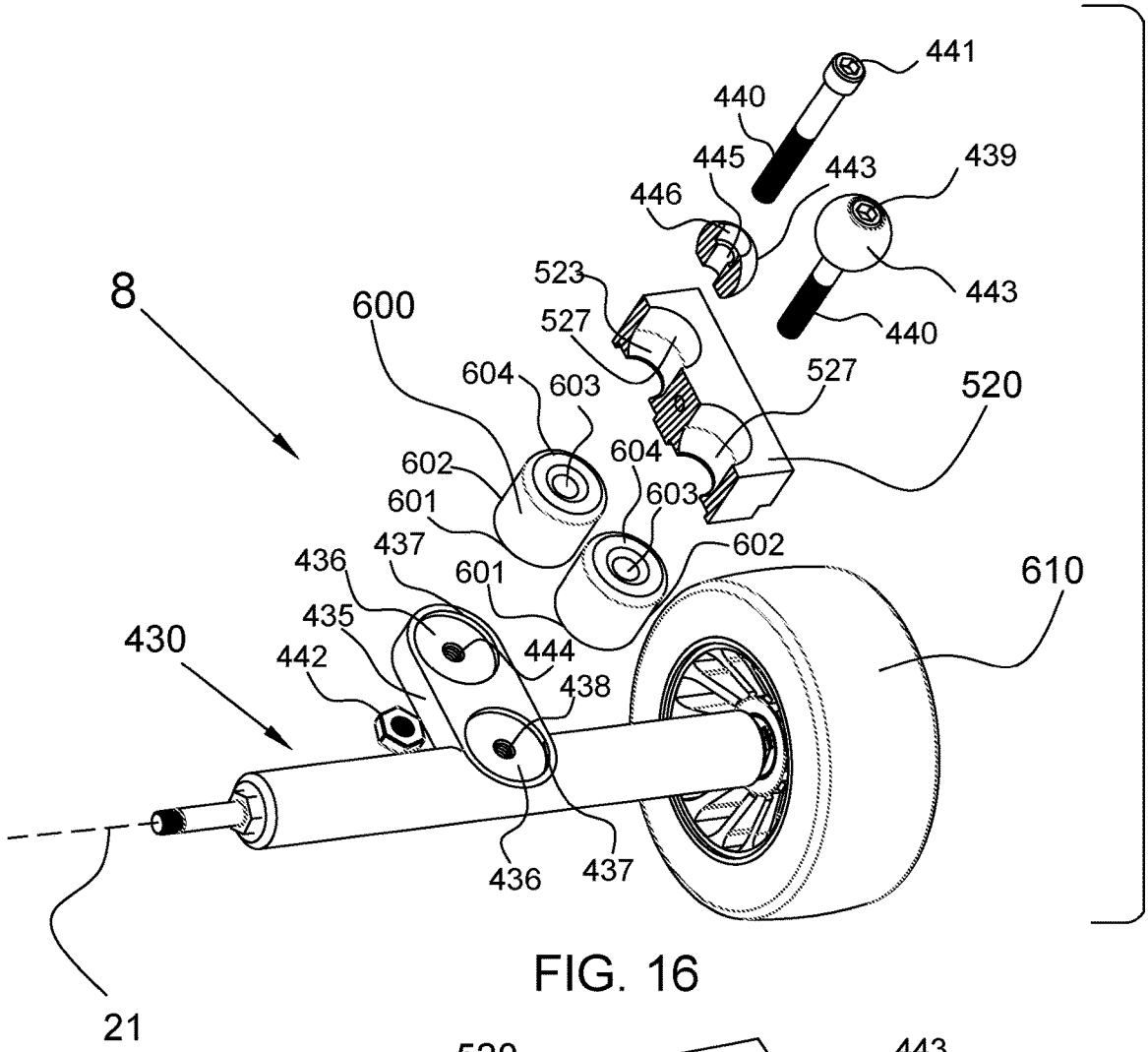
FIG. 16 is an exploded perspective view of assembly 8, showing a third embodiment of the front truck.
Figure 17:
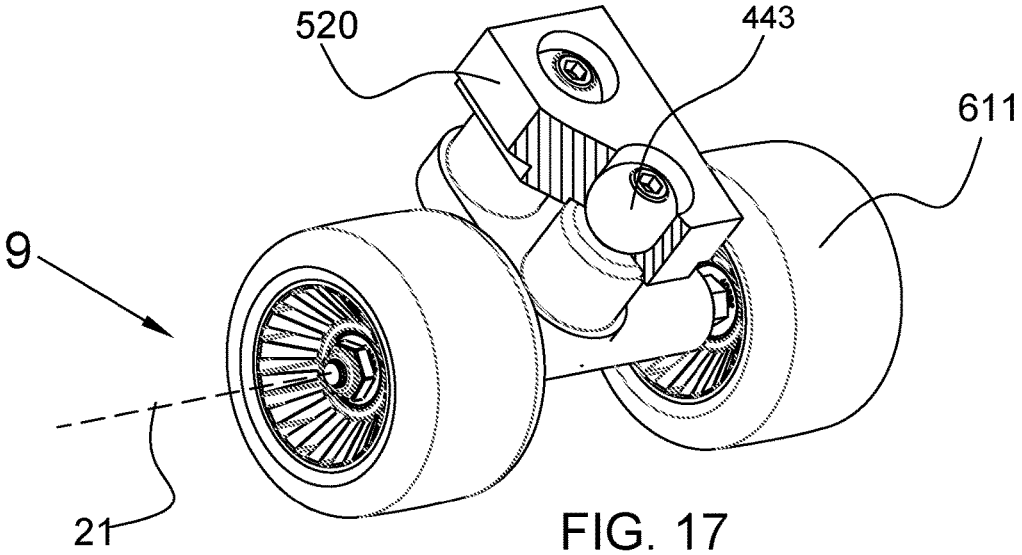
FIG. 17 is an assembled perspective view of assembly 9, showing a third embodiment of the rear truck.
Figure 18:
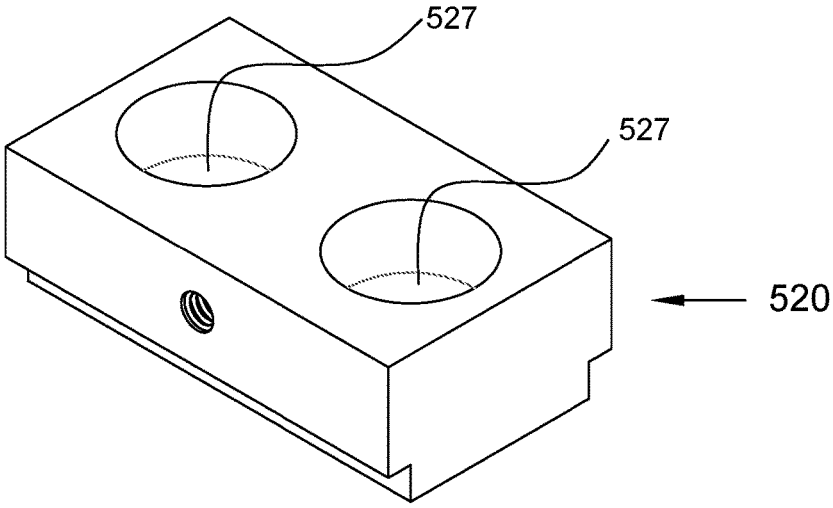
FIG. 18 is a top perspective view of baseblock 520.
Figure 19:
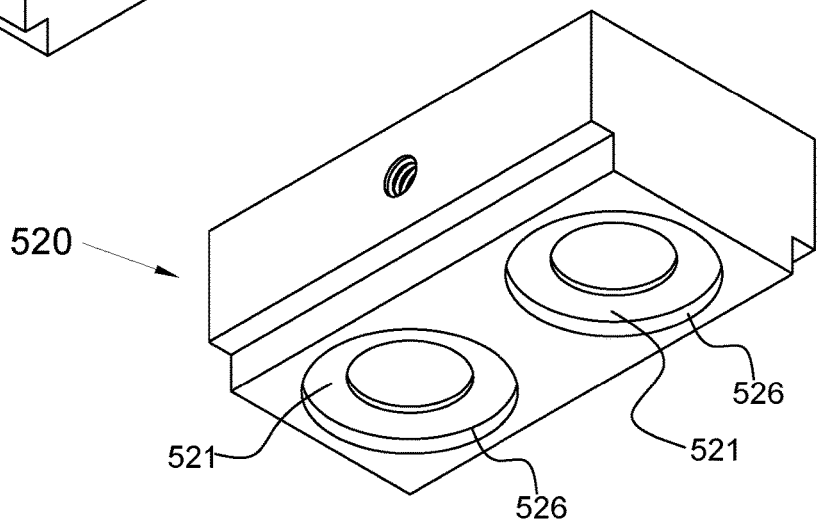
FIG. 19 is a bottom perspective view of baseblock 520.
Figure 20:
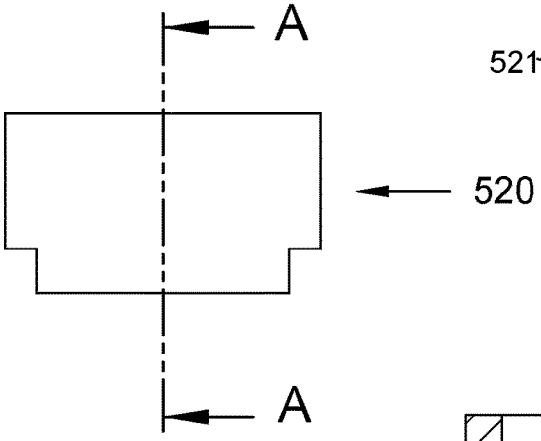
FIG. 20 is a front elevational view of baseblock 520.
Figure 21:
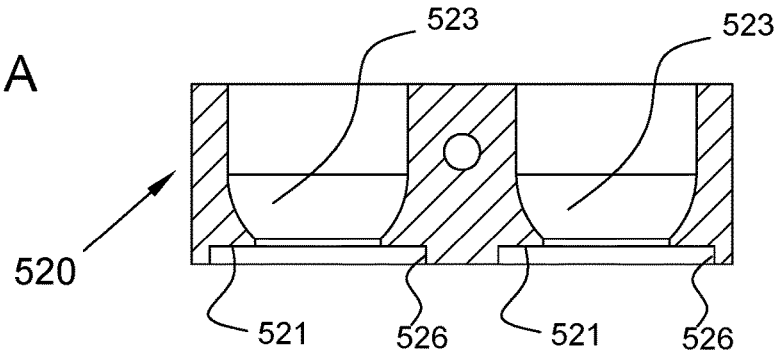
FIG. 21 is a side section view of baseblock 520, along line A-A.

FIG. 16 shows a third embodiment of a front truck, front truck assembly 8 with spherical bearings and detached kingpins. FIG. 17 shows a third embodiment of a rear truck, rear truck assembly 9. Both front and rear truck assemblies are the same with the exception that the rear truck has a narrower wheel track, shorter axle, and smaller wheels than front truck.

Front truck assembly 8 is comprised of front hanger assembly 430 comprised of projecting member 435, a first kingpin 439 and a second kingpin 441, a first spherical bearing and a second spherical bearing 443, a first elastomeric component and a second elastomeric component 600, a baseblock 520, and a first and second wheel 610.

In a preferred embodiment, baseblock 520 is the same as used in truck embodiments 6 and 7 previously described and shown in FIGS. 18-21.

A first kingpin 439 passes through first bore 445 of a first spherical bearing 443. In a preferred embodiment, first counter-bore 446 receives the head of the first kingpin so forming kingpins with spherical heads. A second kingpin 441 passes through second bore 445 of a second spherical bearing 443. In the preferred embodiment, second counter-bore 446 receives the head of second kingpin so forming kingpins with spherical heads. Kingpins with spherical heads may be formed by other means known in the art.

Assembly of front truck embodiment 8 has a first threaded kingpin 439 with a spherical bearing 443 attached pass through a first access hole 527 of baseblock 520 and through a first bore 603 of a first elastomeric component 600. A second threaded kingpin 441 with a second spherical bearing 443 attached passes through a second access hole 527 of baseblock 520 and through a second bore 603 of a second elastomeric component 600. The outer surface of a first spherical bearing 443 mates with a first bearing surface 523 of baseblock 520, and the outer surface of a second spherical bearing 443 mates with a second bearing surface 523 of baseblock 520. In a preferred embodiment, each kingpin has threads 440 at the bottom end and the spherical bearing at the top end. First kingpin 439 with threads 440 threads into first hole 438 disposed within the first recessed area of hanger 430. Second kingpin 441 threads into and through second hole 444 disposed within the second recessed area of hanger 430 and is secured by nut 442 on threads 440.

The first top surface 604 and the first top portion of side surface 602 of the first elastomeric bushing is received and constrained by the first recess 521 and first side surface 526 of baseplate 520. The first bottom surface 601 and the first bottom portion of the side surface 602 of the first elastomeric component 600 is received and constrained by the first recessed area 436 and first side surface 437 of projecting member 435. The second top surface 604 and the second top portion of side surface 602 of the second elastomeric bushing is received and constrained by the second recess 521 and second side surface 526 in the bottom surface of baseplate 520. The second bottom surface 601 and the second bottom portion of the side surface 602 of the second elastomeric component 600 is received and constrained by the second recessed area 436 and second side surface 437 of projecting member 435.

Tightening or loosening kingpins 439 and 441 controls the preload force of elastomeric components 600. Adjustment may be fixed and secured by lock nut 442 on kingpin 441.

Truck assemblies 8 and 9 connect to front and rear angle frame members 202 and 203 of frame 200 in the same manner as truck assemblies 4 and 5 described previously. Wheels 610 attach to hanger 430 in the same manner as described previously for truck assembly 4.

Truck assemblies 8 and 9 provide similar ride dynamics as the previous embodiment. Both front and rear truck assembly 8 and 9 are comprised of two rigid bodies and two elastomeric bushing. The first rigid body is comprised of the hanger assembly and two integrated kingpins 440 where each kingpin is connected with a spherical bearing 443. The second rigid body is the baseblock 520. The two spherical joints function as a revolute joint with a single axis of rotation at the hanger pivot axis located at the centroid point of spherical components 443.

In a riding device, where the baseblock 520 is connected with, and secured to, an angled frame member and the frame, the baseblock and frame comprise the second rigid body. The baseblock is comprised of a top surface, a bottom surface, a front surface, and a back surface. The bottom surface of each baseblock has a first and second recessed area, where each recessed area has a pass through bore. A first threaded kingpin passes through the first pass through bore, and the second threaded kingpin passes through the second pass through bore in the baseblock.

Front truck assembly 8 comprises a hanger assembly with a front axle 430 that is coincident with a front axle axis 21. Front baseblock 520 is connected with front frame angled member 202. Front baseblock 520 has a length that runs from the front surface to the back surface. The length of baseblock 520 is at the same angle relative to the ground as the angle of front angled member 202 relative to the ground. The angle of front angled member 202 relative to the ground is the same as the angle of front hanger pivot axis 22 relative to the ground. Thus, the length of the baseblock, the front angled member, and the front hanger pivot axis all have the same angle relative to the ground. A front virtual pivot point 23 is located at the intersection of a line that projects upward from a central point of the front hanger axle axis 21 and the front hanger pivot axis 22.

Rear truck assembly 9 comprises a hanger assembly with a rear axle 403 that is coincident with a rear axle axis 21. Rear baseblock 520 is connected with rear frame angled member. Rear baseblock 520 has a length that is at the same angle relative to the ground as the angle of rear angled member 203 relative to the ground. The angle of rear angled member 203 relative to the ground is the same as the angle of rear hanger pivot axis 22 relative to the ground. Thus, the length of the baseblock, the rear angled member, and the rear hanger pivot axis all have the same angle relative to the ground. A rear virtual pivot point 23 is located at the intersection of a line that projects upward from a central point of the rear hanger axle axis 21 and the rear hanger pivot axis 22.

The front virtual pivot point and the rear virtual pivot point define a longitudinal roll axis 24. The longitudinal axis 24 is coincident with a virtual projected line between the front and rear virtual pivot points.

Figure 22:
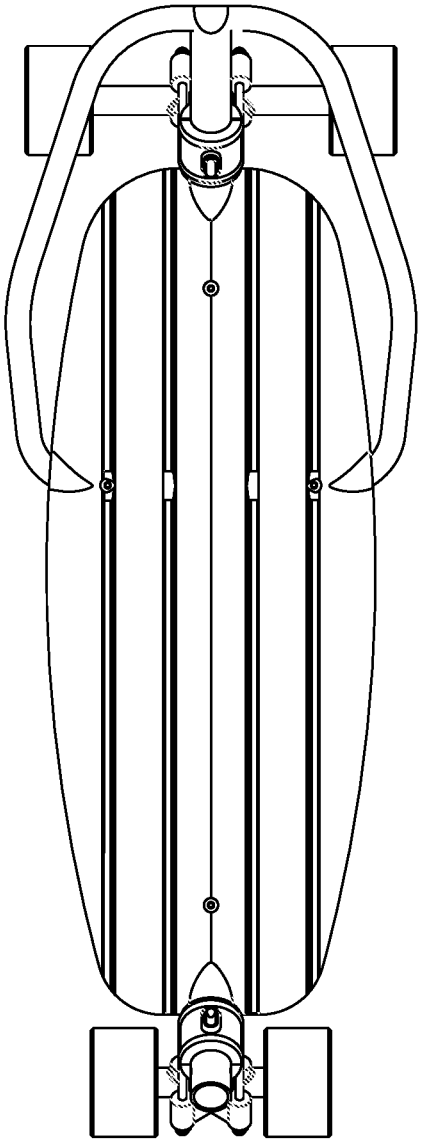
FIG. 22 is a plan view of second embodiment of the invention with handle detached.
Figure 23:
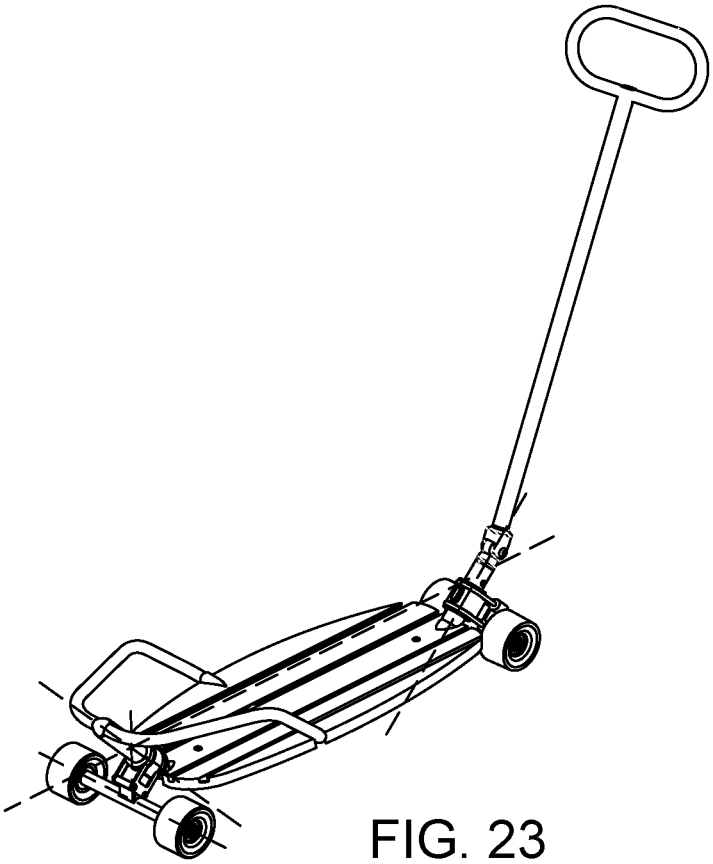
FIG. 23 is a top perspective view of a second kneeboard embodiment with handle attached.
Figure 24:
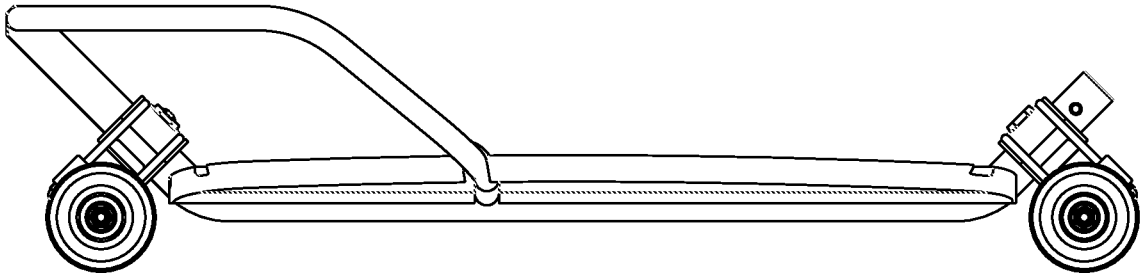
FIG. 24 is a side view of the second kneeboard embodiment with handle detached.

FIGS. 22-24 show another embodiment of the present invention with radial bearing u-bolts.

Figure 25:
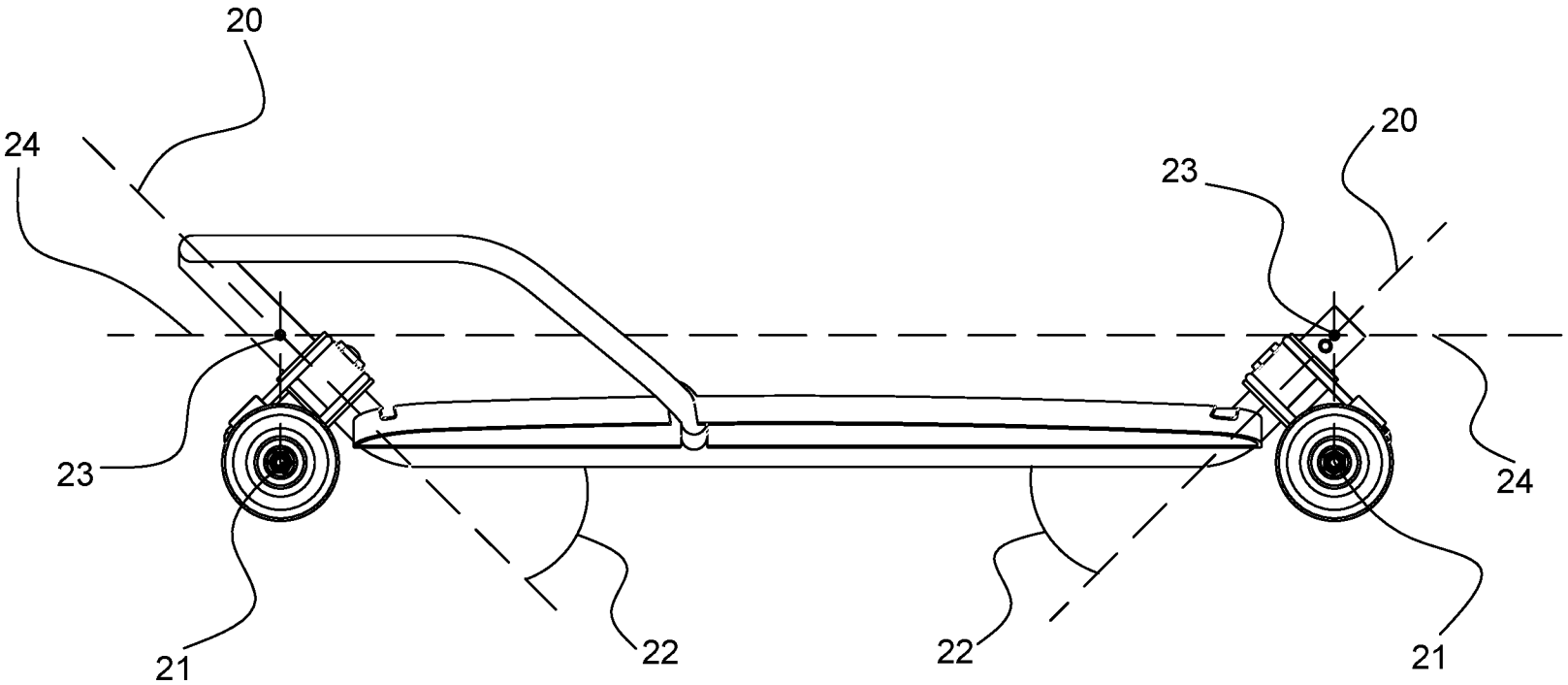
FIG. 25 is a side section view of the second kneeboard embodiment showing virtual pivot points and axes of rotation.

As shown in FIG. 25, the axes and angles of rotation are the same as described previously.

Figure 26:
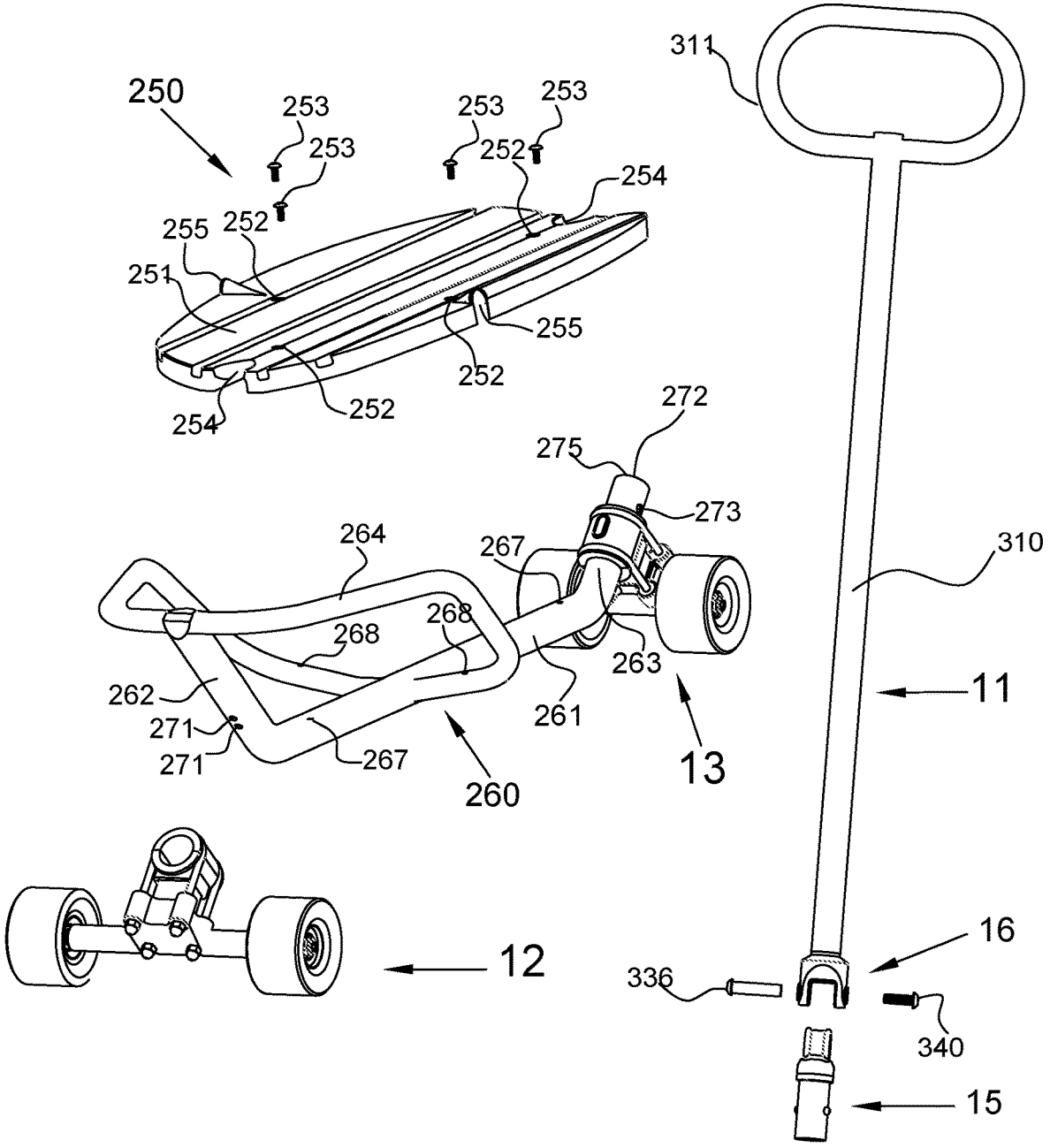
FIG. 26 is an exploded perspective view of the second kneeboard embodiment showing main assemblies.

As shown in FIG. 26, this embodiment is comprised of deck 250, handrail and frame assembly 260, handle assembly 11, and truck assemblies 12 and 13.

Handrail and frame assembly 260 is comprised of a center frame member 261, a front angle frame member 262, a rear angle frame member 263, and handrail 264. The handrail has two side grasping surfaces and a front grasping surface as previously described.

The deck 250 preferably has a soft surface 251 to support the rider. In a preferred embodiment, deck 250 is attached to the frame and handrail assembly 260 via through holes 252 in deck 250 and 267 and 268 in frame 260 using mounting screws 253. Channel 254 of deck 250 mates to the center frame member 261 and the side mating surface 255 of deck 250 contains handrail 264. In other embodiments, the deck is connected with the frame by any means known in the art.

Front truck assembly 12 mounts to front angle frame member 262 and rear truck assembly 13 mounts to rear angle frame member 263.

Handle assembly 11 is comprised of a handle shaft 310, with a handgrip 311 at the top and swivel yoke assembly 16 and universal swivel assembly 15 at the bottom. When combined, swivel yoke assembly 16 and universal swivel assembly 15 form a detachable swivel handle assembly that is contained within recess 272 of rear angle frame member 263.

Figure 27:
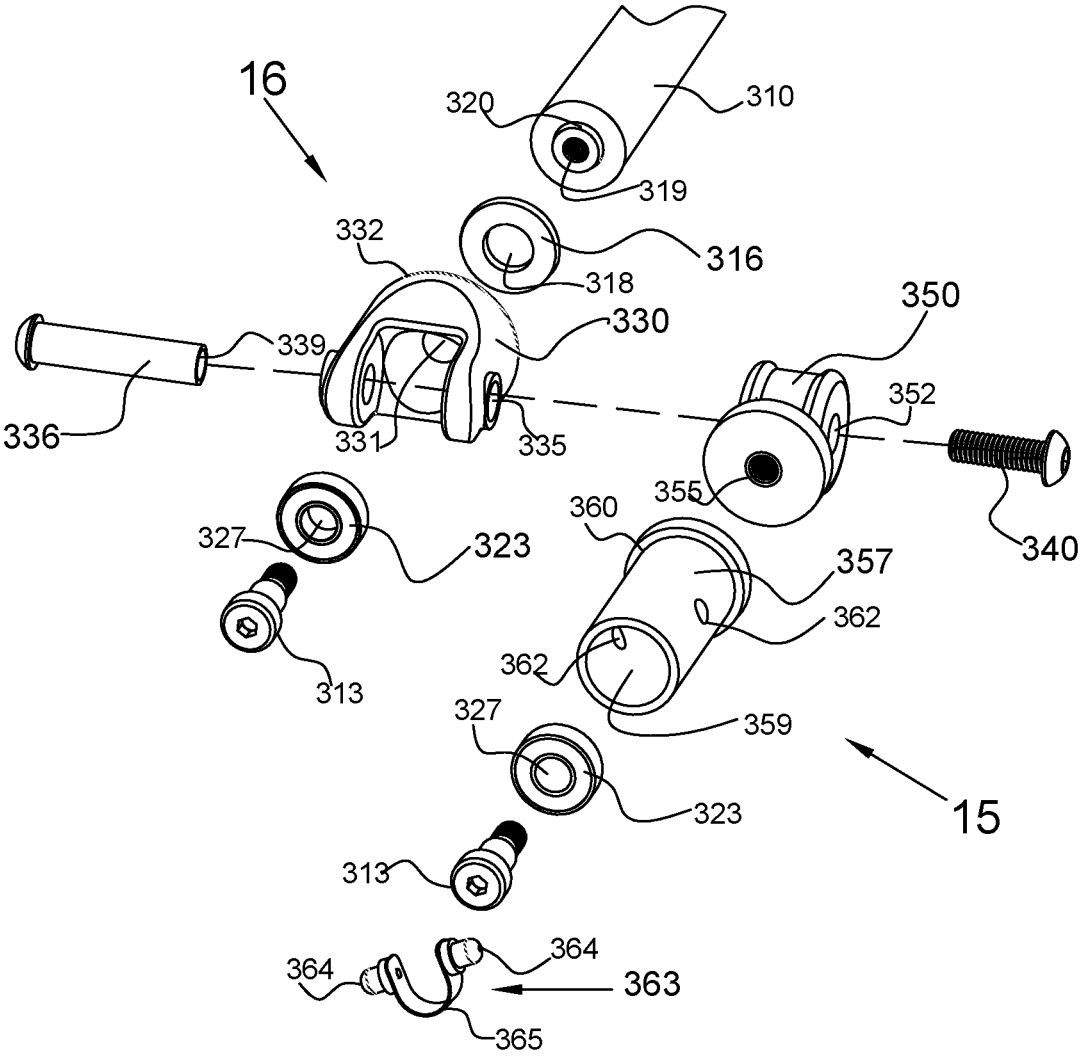
FIG. 27 is an exploded perspective view of universal swivel assembly 15 and swivel yoke assembly 16.

FIG. 27 shows swivel yoke assembly 16 and universal swivel assembly 15.

Assembly sequence is as follows. Swivel yoke assembly 16 has washer 316 sandwiched between swivel yoke 330 and handle 310. Bearing 323 is contained within swivel yoke 330.

A first shoulder bolt 313 passes through a first central bore 327 of the inner race of bearing 323, through the bore 331 of swivel yoke 330, through bore 318 of washer 316 and threads into bore 319 centered on raised boss 320 on handle 310 completing the swivel yoke assembly.

Universal swivel assembly 15 has a second bearing 323 contained within insert swivel base 357. The top surface of swivel insert base 357 mates with the bottom surface of swivel center 350.

Assembly sequence of universal swivel assembly 15 is as follows. A second shoulder bolt 313 passes through second central bore 327 of second bearing 323, through bore 359 of insert swivel center 357 and threads into threaded bore 355 of universal swivel center 350. Tightening second shoulder bolt 313 securely locks the assembly together such that insert swivel base 357 can rotate freely about a common central axis relative to universal swivel center 350.

Universal swivel assembly 15 and swivel yoke assembly 16 are assembled as follows. Universal swivel center 350 fits within swivel yoke 330 and connecting cap nut 336 passes through bore 335 of swivel yoke 330 and through bore 352 in swivel center 350. Connecting bolt 340 threads into threaded hole 339 in connecting cap creating a revolute joint.

Spring button assembly 363 is comprised of flat spring 365 connected with a first spring button head 364 and a second spring button head 364. Final assembly of universal swivel assembly has each spring button head 364 of spring button assembly 363 contained by one cross bore 362 of swivel base 357.

FIG. 26 shows quick detachable swivel handle assembly 11 detached from frame assembly 260. Swivel handle assembly 11 attaches to the rear angle frame member 263 by inserting swivel base 357 into interior cavity 272 of rear angle frame member 263. Depressing spring button heads 364 allows full insertion of swivel base 357 until outer lip 360 of insert swivel base 357 mates with top surface 275 of rear frame member 263. Spring button heads 364 protrude from transverse through holes 273 in rear angle frame member 263. Depressing spring button heads 364 also allows release of universal spring assembly 15 from angled rear frame member 263 to remove handle assembly 11.

Figure 28:
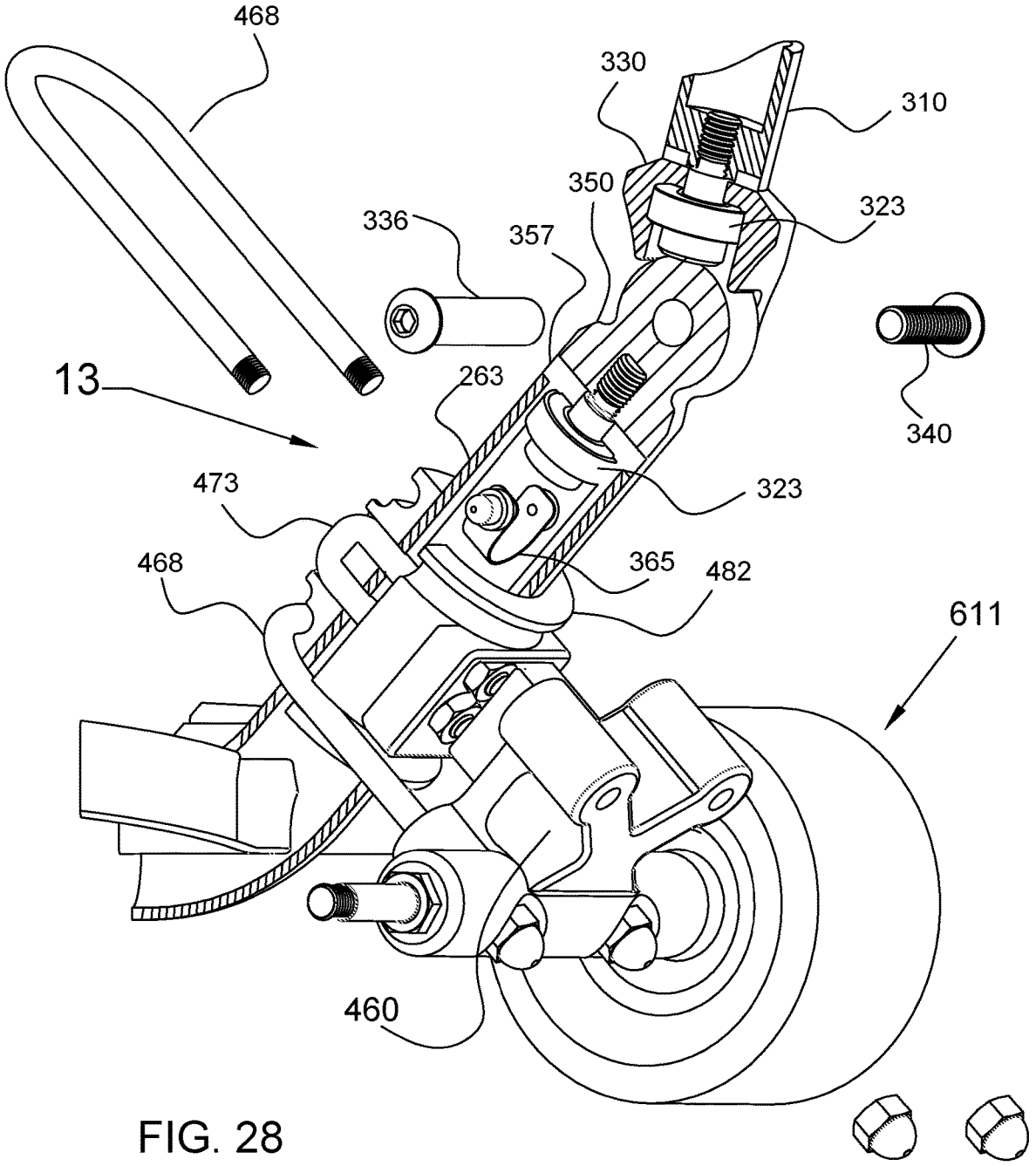
FIG. 28 is a perspective cut away section view of the second kneeboard embodiment showing assembled components of the rear end.

FIG. 28 shows cutaway side section view of assembled swivel handle assembly 11 mounted within frame member 263.

Front truck assembly 12 and rear truck assembly 13 are each comprised of two rigid bodies, and at least one elastomeric component. The first rigid body comprises the hanger assembly 460 with projecting member 465 connected with at least two radial u-bolts 468. The second rigid body comprises an upper base-bushing 477, a lower base-bushing 482, and a mounting u-bolt 473 secured to the base-bushings. When connected with an angled frame member, the second rigid body further comprises the angled frame member.

Figure 29:
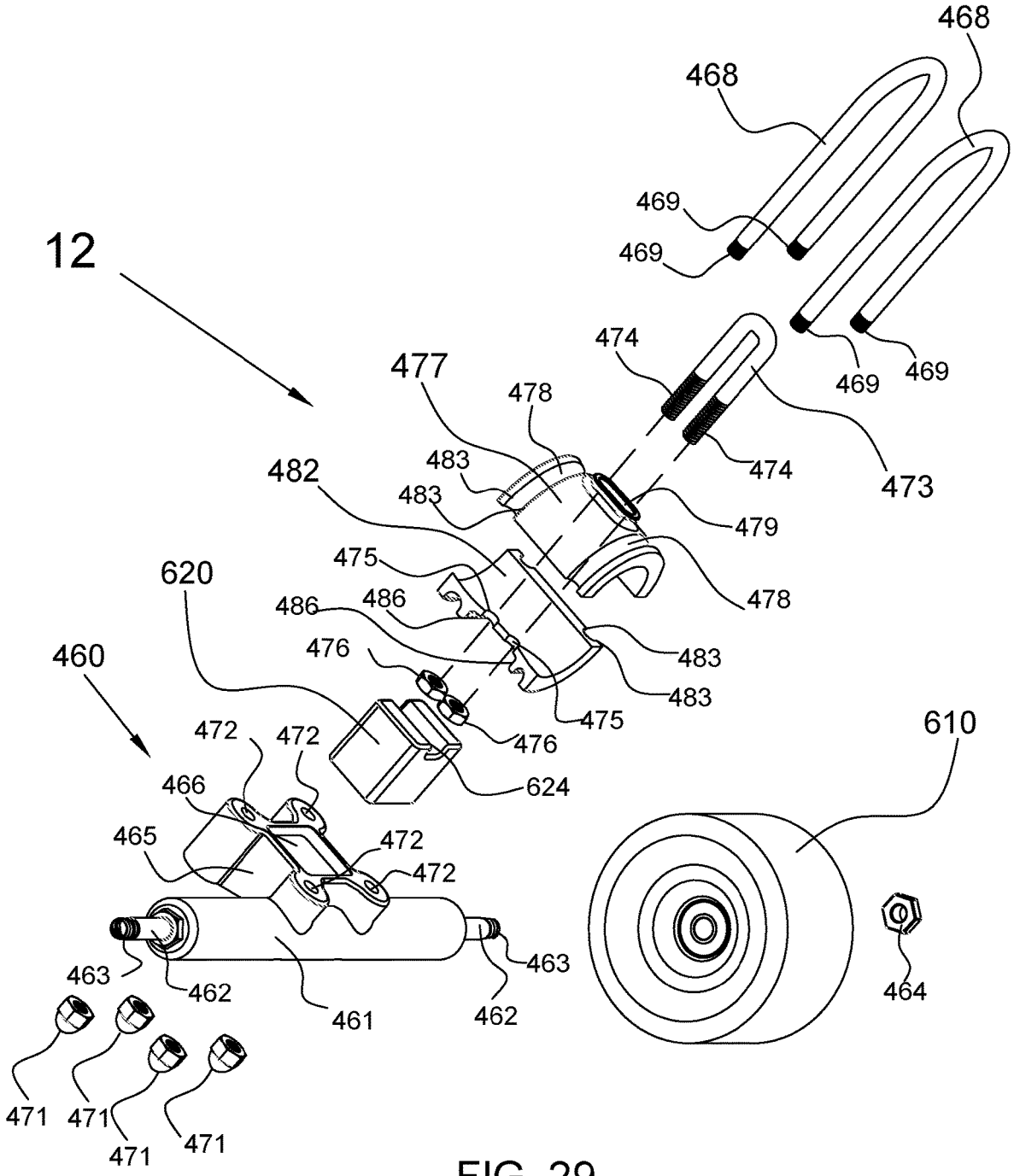
FIG. 29 is an exploded perspective view of front truck assembly 12.
Figure 30:
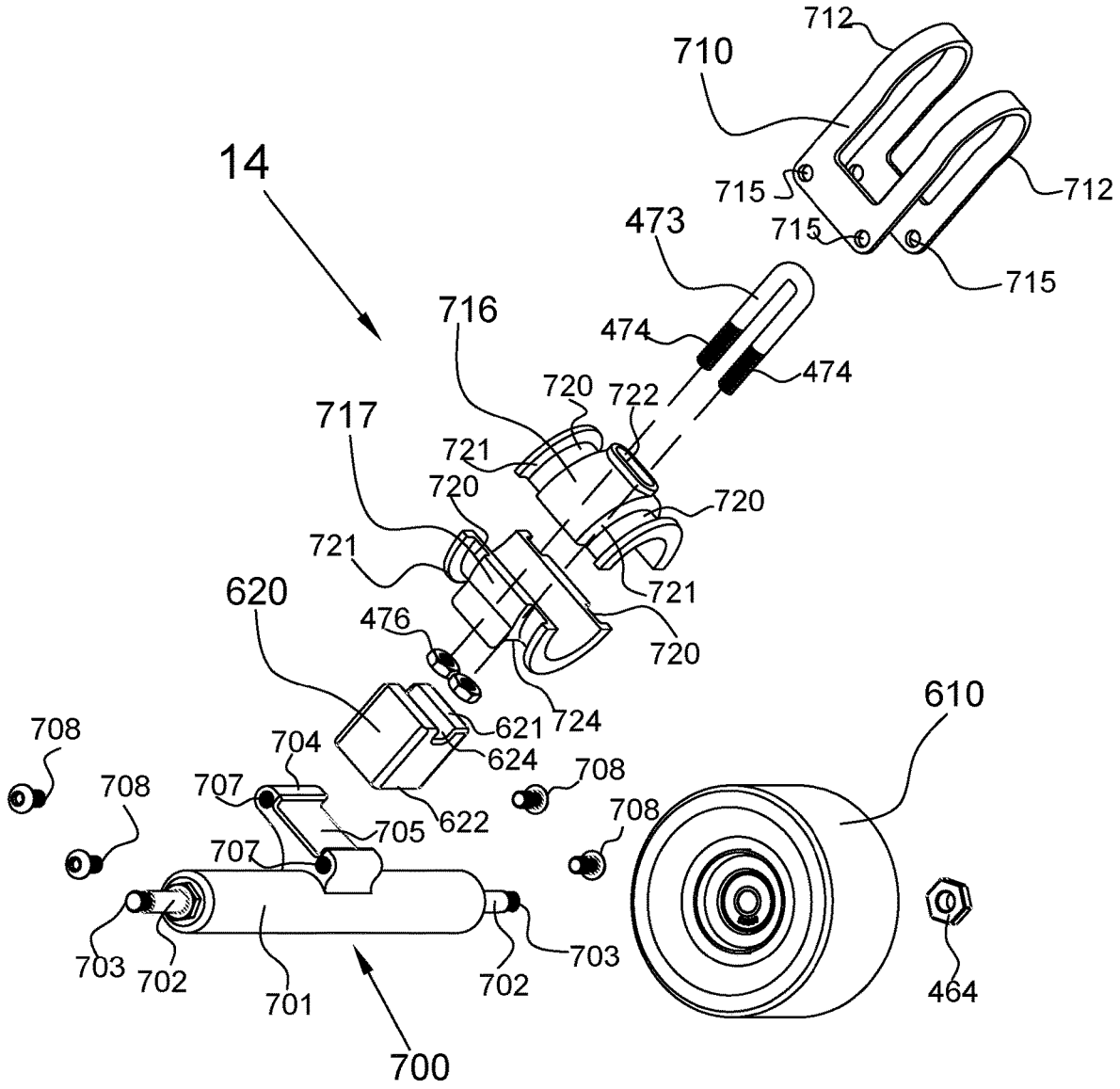
FIG. 30 is an exploded perspective view of truck assembly 14.

FIG. 29 shows an exploded perspective view of front truck assembly 12. FIG. 30 shows an exploded perspective view of front truck assembly 14. Both front truck assembly 12 and front truck assembly 14 are connected to front angled frame member 262 by means of a revolute joint formed by radial u-connectors. A hanger pivot axis 20 is defined by the centroid axis of the radial u-connectors and revolute joints. Elastomeric components provide a return to center force. In front truck assembly 12, the radial u-connectors comprises two radial u-bolts 468, and in front truck assembly 14, the radial u-connectors comprises radial u-strap 710 with two side surfaces 712. Similarly, riding devices using these trucks have similar riding dynamics, with a front virtual pivot point 23 and a rear virtual pivot point 23 located at the intersection of a line projecting upward from a central point of the front and rear hanger axle axis 21, and the front and rear hanger pivot axis 20, respectively. A longitudinal roll axis 24 is coincident with a virtual line between the front virtual pivot point 23 and the rear virtual pivot point 23.

Front truck assembly 12 is comprised of hanger assembly 460, wheels 610, elastomeric component 620, upper base-bushing 477, lower base-bushing 482, mounting u-bolt 473, and radial bearing u-bolts 468. Mounting u-bolt 473 secures upper base-bushing 477 to lower base-bushing 482 with the inside surfaces of the base-bushings defining a space in the shape of a hollow column with a circumference and a length, where the circumference is sized to receive an angled frame member 262. A virtual line running the length at the circumference at the center of the hollow column defined by the base bushing is coincident with the hanger pivot axis 20.

Hanger assembly 460 is comprised of horizontal member 461 that surrounds axle 462, projecting member 465, and two laterally spaced wheels. One wheel 610 is secured to each end of axle 462 by a locking nut 464 threaded with threads 463.

Assembly sequence of front truck assembly 12 with frame 260 has two operations. A first assembly operation mounts base-bushings 477 and 482 to angled frame member 262. A second assembly operation mounts hanger assembly 460 to base-bushings 477 and 482 with radial u-bolts 468.

Base-bushings 477 and 482 define a hollow column that clamps around front angled frame member 262 and mounting u-bolt 473 inserts through holes in the recessed area 479 of upper base-bushing 477, through holes 271 of angled frame member 262 and out through holes 475 of lower base-bushing 482. Tightening nuts 476 on threads 474 provides clamping pressure to secure base-bushings 477 and 482 to angled frame member 262 fixing position both radially and axially.

A first radial u-bolt 468 slides within a first or forward radial bearing channel 478 of upper and lower base-bushings 477 and 482, and a second radial u-bolt 468 slides within a second or rear radial bearing channel 478 of upper and lower base-bushings 477 and 482. Each radial u-bolts 468 is constrained by side surfaces 483 of each radial bearing channel 478 to form a revolute joint about hanger pivot axis 20. The hanger pivot axis is at the same angle relative to the ground as the angle relative to the ground of the front angled member.

Top surface of elastomeric component 620 mates within recessed area 486 of lower base-bushing 482 and nuts 476 are enclosed within channel 624 of elastomeric component 620. Bottom surface of elastomeric component 620 mates within recessed area 466 of hanger assembly 460.

In a preferred embodiment, each radial u-bolt 468 has a first threaded end 469 and a second threaded end 469 for a total of four threaded ends. Each threaded end 469 of each radial u-bolts 468 passes through one of four holes 472 in projecting member 465 of hanger assembly 460. Four locking nuts complete the assembly. Each end of the forward radial u-bolt is secured to one forward hole in the projecting member, and each end of the rear radial u-bolt is secured to one rear hole in the projecting member. One locking nut 471 threads onto each threaded end 469 of radial u-bolts 468. Tightening locking nuts 471 adjusts the preload force on elastomeric component 620 such that the tighter locking nuts 471 are adjusted, the greater the preload force on elastomeric component 620 and vice-a-versa. It is apparent that the u-bolts may be connected to the projecting member by any means known in the art.

Front and rear truck assemblies 12 and 13 are the same except the front wheel track and front axle are wider than the rear wheel track and rear axle. Assembly of rear truck assembly 13 with rear angled frame member 263 is the same as described for front truck assembly 12 with front angled frame member 262.

FIG. 28 shows rear truck assembly 13 mounted on rear angled frame member 263.

FIG. 30 shows an exploded perspective view of another embodiment of the front truck assembly. Both the front truck assembly 14 and the rear truck assembly each comprise two rigid bodies and at least one elastomeric component. The first rigid body comprises a radial bearing u-strap 710 and a hanger assembly 700. The second rigid body comprise an upper base-bushing 716, a lower base-bushing 717, and a mounting u-bolt 473. When connected with the frame, the first rigid body further comprises the frame.

Front truck assembly 14 mounts on front angled frame member 262 of frame assembly 260. Truck assembly 14 is comprised of hanger assembly 700, wheels 610, elastomeric component 620, upper base-bushing 716 and lower base-bushing 717, mounting u-bolt 473, and radial bearing u-straps 710.

Hanger assembly 700 is comprised of horizontal member 701 that surrounds axle 702, projecting member 704, and two laterally-spaced wheels. Each end of axle 702 supports one of the two laterally-spaced wheels 610. Each wheel is secured by locking nut 464 threaded onto threads 703.

Assembly sequence of front truck assembly 14 with frame 260 has two operations. A first assembly operation mounts base-bearings 716 and 717 to angled frame member 262. A second assembly operation mounts hanger assembly 700 to base-bushings 716 and 717 with radial u-strap 710.

Base bushings 716 and 717 define a hollow column that clamps around front angled frame member 262 and each end of mounting u-bolt 473 inserts through holes of recessed area 722 of upper base-bushing 716, through one of two holes 271 of angled frame member 262 and out one of two through holes in lower base-bushing 717. The inside surfaces of the base-bushings define a space in the shape of a hollow column with a circumference and a length, where the circumference is sized to receive an angled frame member 262. A virtual line running the length at the circumference at the center of the hollow column defined by the base bushing is coincident with the hanger pivot axis 20.

Tightening nuts 476 on threads 474 on each end of mounting u-bolt 473 provides clamping pressure to secure base bushings 716 and 717 to angled frame member 262 fixing position both radially and axially.

Radial u-strap 710 has a first or forward strap 712 and a second or rear strap 712. A first or forward strap 712 slides within a first or forward radial bearing channel 720 of upper and lower base-bushings 716 and 717, and a second or rear strap 712 slides within a second or rear radial bearing channel 720 of upper and lower base-bushings 716 and 717. Each strap 712 of u-strap 710 is constrained by side surfaces 721 of each corresponding radial bearing channel 720 to form a revolute joint.

Each side surface 712 of the radial bearing u-strap 710 is constrained by side surfaces 721 of each corresponding radial bearing channel 720 to form a revolute joint about hanger pivot axis 20. The hanger pivot axis is at the same angle relative to the ground as the angle relative to the ground of the front angled member.

Top surface 621 of elastomeric component 620 mates within recessed area 724 of lower base-bushing 717 and nuts 476 are contained within channel 624 of elastomeric component 620.

Bottom surface 622 of elastomeric component 620 mates within recessed area 705 of projecting member 704 of hanger assembly 700.

Mounting screws 708 pass through holes 715 of u-strap 710 and thread into holes 707 of projecting member 704 to complete the assembly. The forward u-strap is secured to forward holes in the projecting member, and the rear u-strap is secured to rear holes in the projecting member.

Front and rear truck assemblies 14 and 15 are the same except the front wheel track and front axle are wider than the rear wheel track and rear axle.

Assembly of rear truck assembly 15 with rear angled frame member 263 is the same as described for front truck assembly 14 with front angled frame member 262.

Play Pattern Ride Dynamics

Lean steering/side to side balance

Phase 1: Become familiar with lean steering and master basic side to side balance to stay upright.

The present in invention provides a safe shared parent/child play pattern and learning journey. As the parent pushes the device they see and feel the child leaning right or left and the device steering in response. At the beginning the parent pushes or pulls child slowly with the child trying sitting and kneeling positions. The parent and child quickly learn to go in a straight line and so the present invention becomes a form of transportation similar to a stroller or wagon.

The wide wheel track of the front wheels helps prevent tip over during aggressive leaning thus encouraging confidence, experimentation and learning. The narrow wheel track of the rear wheels provides fuller access for mounting and dismounting and later for pushing and braking.

The handrails provide security for the child by helping keep their bodies centered on the deck both sitting and kneeling. As well, holding the handrails supports front to back balance effectively reducing feelings of "falling" forward or backward.

Parental control of propulsion provides extended play which allows the child freedom to learn at their own rate, to experiment with leaning right and left and become comfortable with the sensations of lean steering, first executing wide radius slow gentle turns, progressing to full circle turns, and later linked slalom-like turns.

Parental control of propulsion allows the child to safely learn the relationship between speed over ground and the rate of turn for a given amount of deck lean. This in turn, lets the child practice adjusting their body mass to align with the vector of the turn they are in and later to shift their body mass in advance of changes of vector for the upcoming turn.

Phase 2: Master Side to Side Balance while Turning.

As the child gains confidence they will inevitably lean their body more steeply putting their center of mass outside the wheel track leading to a tip over. Learning to fall is part of the play pattern and is safely learned on grass or other soft surface. When turning on pavement and not falling leaning "too far" will cause children to instinctively push down on the handrail on the inside of the turn. Doing so increases deck lean and steers the device back underneath them.

Phase 3: Deliberately Create Turns.

By design the direct feedback and control of the present invention teaches the child to lean just enough to steer where they want to go, as deep as they want, how to modulate the turn in relation to speed, and how to steer the device back underneath when they have leaned too far. With practice the child not only gains balance in a given turn but learns to control both the rate of turn and the timing of initiating and finishing a turn such that going straight and turning become natural and established skills.

Phase 4: Linked Turns.

Children leaning the deck slightly right or left stay within the stability of the front wheel track. With deeper turns, children learn to keep their balance by adjusting the angle of lean and the radius of the turn. Changing direction of turn requires a child to lean more and steer more to drive the device underneath their center of balance. Doing so shifts their mass to the opposite side of the device to initiate the opposite turn. Children are then free to steer toward their newly shifted center of mass to align with the needed vector of the upcoming turn in the opposite direction. As the child turns more aggressively they begin to feel the sensation of deep lean and carving and the weightless sensation of floating between turns.

They lean to shift their mass in advance of the turn, then lean the deck the amount that is need for the desired turn radius.

One Foot-Two Foot Balance

Once the parent feels that the child has sufficient mastery of lean steering and side to side balance, they can detach the handle and allow the child to control propulsion and braking on their own.

Independent propulsion can be provided by the parent pushing the child on the device, by gravity while riding down hills, or by the child kicking with their foot on the ground.

Kicking on the ground lets the child control speed by pushing with their foot to accelerate or by dragging their foot to decelerate and stop.

To do this, the child must take one knee off the deck and place their foot on the ground. At the same time doing so requires that they shift their center of mass toward the center of the wheel track to counterbalance and maintain directional control.

Lastly, the child learns to shift their mass side to side so as to match foot pressure on the ground when kicking forward or braking.

Handrails greatly support learning to shift rider mass side to side and remain stable front to back when kicking and braking.

Front to Back Balance

When a child lets go of the handrail, they learn to use core trunk muscles to provide front to back stability to keep from falling frontwards or backwards during accelerations or decelerations This skill is secondary to riding the kneeboard, but is an essential part of mastering other board sports such as skateboarding, surfing, snowboarding, or skiing.

Child and Parent Learning Milestones

Child Learning Milestones.

Mounting and dismounting to kneeling and sitting positions. Includes correct body positions, hand positions, and feet positions.

Coordinates with parent to sit when being pulled in "wagon" mode

Coordinates with parent to kneel when being pushed in "kneeboard" mode.

Communicates with parent to choose to be pushed or pulled.

Learns to brace with changes of acceleration and deceleration from being pushed or pulled by parent.

Learns basic lean steering, look right, lean right, steer right (and left). Both sitting and kneeling.

Able to keep a straight course direction when being pushed or pulled.

Gains control of the radius of turns with understanding that more leaning results in tighter turning radius.

Experiments with not holding on with hands. First when sitting and then kneeling.

Learns how to sustain full circle turns.

Shows confidence transitioning from turning one way to the other.

Shows the ability to look forward while turning and begins to gain control of the timing of turns.

Experiments with feet touching ground and rear wheels when sitting and being pulled.

Learns how to brake with feet on ground or wheels when sitting.

Learns how to brace for changes of ground surface like bumps, and the transition from pavement to grass or dirt.

Learns to steer around obstacles and hazards (poles, benches) when pushed with handle.

Learns to drive from pavement to grass or dirt for fun with parent pushing handle.

Learns to mount and dismount with handle detached.

Becomes free range kneeboard rider

Learns to turn independently with parent pushing and letting child glide indecently sitting or kneeling.

Learns to self-propel with one knee on deck and one foot pushing on ground.

Learns to self-brake with one knee on deck and one foot skidding on ground.

Practices rolling onto grass to stop and for fun, and to comply with parent's safety limits.

Learns to control speed by turning, braking with foot, or driving onto grass as play pattern expands to include gentle playground slopes and paths.

Experiments turning without holding onto handrail.

Progresses toward mastery of lean steering and side to side balance when able to link turns and change radius of turns without holding onto handrail.

Begins to slide turns by going faster and turning harder than available traction. Crashes to follow.

With practice learns to control timing, direction, and magnitude of slides while maintaining balance.

Kneeboard mastery is demonstrated by consistent directional control, speed control with foot braking, turns and slides, and by linked carving turns.

Parent Learning Milestones.

Recognizes kneeboard represents a parent/child play pattern and learning journey.

Learns when child is safely positioned either sitting or kneeling.

Learns to stop and gently pull up with handle to reposition rear wheels to path of travel.

Learns to provide soft start and soft stop pulling or pushing becoming more aggressive when encouraged to do so by child.

Learns to push handle while skateboarding or skating.

Observes child experimenting with leaning and turning.

Effectively communicates and coordinates with child to get from A to B in generally straight paths pushing or pulling.

Learns to select play areas that match child's skills and learning needs. (starting with open, flat, smooth playgrounds, sloped areas with safe grass runout)

Learns to space slalom cones to match child's control of turn radius and timing.

Observes child's learning about moving surfaces, speed, relative to their body parts.

Becomes attuned to child's comfort level and desire for more aggressive stimulation and speed.

Involves cooperative play to provide steering and turning challenges.

Recognizes child level of directional and speed control and selects appropriately safe play areas.

Learns to push child without handle and let child glide independently.

Continues supervision and encouragement.

The above description presents the best mode contemplated in carrying out the invention(s) described herein. However, it is susceptible to modifications and alternate constructions from the embodiments shown in the figures and accompanying description. Consequently, it is not intended that the invention be limited to the particular embodiments disclosed. On the contrary, the invention is intended to cover all modifications, sizes and alternate constructions falling within the spirit and scope of embodiments of the invention.

What is claimed is:

1. A truck for a riding device comprising, two rigid bodies, a first rigid body comprising a hanger assembly and a cylindrical bearing, a second rigid body comprising a baseblock with a central bore, wherein the central bore receives the cylindrical bearing, and the cylindrical bearing moveably rotates within the central bore forming a revolute joint, two elastomeric bushings sandwiched between a projecting member of the hanger assembly and a bottom surface of the baseblock, a first threaded kingpin that protrudes from the projecting member through a first bushing bore in a first elastomeric bushing, through a first oval bore with a length in a bottom surface of the baseblock, through a first pass through bore in the cylindrical bearing, wherein a first nut threads onto the first threaded kingpin, tightening against the cylindrical bearing, a second threaded kingpin that protrudes from the projecting member through a second bushing bore, a second oval bore with a length in the bottom surface of the baseblock, a second pass through bore in the cylindrical bearing, wherein a second nut threads onto the second threaded kingpin, tightening against the cylindrical bearing, the length of the oval bores defines the degree of rotation of the cylindrical bearing relative to the baseblock, thereby defining the degree of rotation of the first rigid body around a hanger pivot axis relative to the second rigid body.

2. The truck of claim 1 further comprising, two rigid bodies, a first rigid body comprising a hanger assembly and a cylindrical bearing, a second rigid body comprising a baseblock connected with an angled member, the hanger assembly comprising, a horizontal member surrounding an axle connected with two laterally-spaced wheels, a projecting member with a first recessed area with a first side surface and a first threaded kingpin protruding from the first recessed area, and a second recessed area with a second side surface and a second threaded kingpin protruding from the second recessed area, the cylindrical bearing comprising a cylindrical surface, a first pass through bore disposed within a first flat surface, a second pass through bore disposed within a second flat surface, and a length coincident with a revolute joint and a hanger pivot axis, the angled member comprising a cavity that receives and constrains the baseblock, the baseblock comprising a top surface, bottom surface, front surface, and back surface, and further comprising, a central bore with a bearing surface running between the baseblock front surface and back surface that receives the cylindrical surface of the cylindrical bearing forming the revolute joint, the bottom surface comprising a first recessed area with a first side surface and a first oval bore with a length disposed within the first recessed area, and a second recessed area with a second side surface and a second oval bore with a length disposed within the second recessed area, at least one access hole in the top surface, two elastomeric bushings sandwiched between the projecting member of the hanger and the bottom surface of the baseblock, a first elastomeric bushing with a first top surface, a first outside surface, a first bottom surface, and a first bushing bore, wherein the first recessed area and first side surface of the projecting member receive and constrain the bottom surface and a lower portion of the side surface of the first elastomeric bushing, and the first recessed area and first side surface of the baseblock receive and constrain the top surface and a top portion of the side surface of the first elastomeric bushing, a second elastomeric bushing with a second top surface, a second outside surface, a second bottom surface, and a second bushing bore, wherein the second recessed area and second side surface of the projecting member receive and constrain the bottom surface and a bottom portion of the side surface of the second elastomeric bushing, and the second recessed area and second side surface of the baseblock receive and constrain the top surface and a top portion of the side surface of the second elastomeric bushing, wherein the first bushing bore receives the first kingpin and the second bushing bore receives the second kingpin, the first threaded kingpin protrudes from the projecting member through the first bushing bore, the first oval bore, the first pass through bore in the cylindrical bearing, and into the access hole, wherein a first nut threads onto the first kingpin, tightening against the first flat surface of the cylindrical bearing, the second threaded kingpin protrudes from the projecting member through the second bushing bore, the second oval bore, the second pass through bore of the cylindrical bearing, and into the access hole, wherein a second nut threads onto the second kingpin, tightening against the second flat surface, wherein the length of the oval bores defines the degree of rotation of the cylindrical bearing relative to the baseblock, thereby defining the degree of rotation of the first rigid body around a hanger pivot axis relative to the second rigid body.

3. The truck of claim 1, wherein a front truck and a rear truck connected with a frame comprise a riding device, further comprising, the frame comprising a front angled member, a central member, and a rear angled member, a front baseblock secured within the front angled member, and a rear baseblock secured within the rear angled frame member each baseblock comprising a top surface, bottom surface, front surface, and back surface, and the central bore running a length of the baseblock between the front surface and back surface, with a bearing surface that receives a cylindrical surface of the cylindrical bearing forming the revolute joint, a front hanger pivot axis coincident with the front angled member and the length of the front baseblock and, wherein a front revolute joint rotates around the front hanger pivot axis, a rear hanger pivot axis coincident with the rear angled member and the length of the rear baseblock, wherein a rear revolute joint rotates around the rear hanger pivot axis, the front truck further comprising a front virtual pivot point at the intersection of a line projecting upward from a central point of a front hanger axle axis and the front hanger pivot axis, the rear truck further comprising a rear virtual pivot point at the intersection of a line projecting upward from a central point of a rear hanger axle axis and the rear hanger pivot axis, a longitudinal roll axis coincident with a virtual line between the front virtual pivot point and the rear virtual pivot point.

4. The riding device of claim 3 further comprising a front axle surrounded by a front horizontal member and two laterally spaced wheels connected with the front axle, and a rear axle surrounded by a rear horizontal member and two laterally spaced wheels connected with the rear axle wherein the front axle is longer than the rear axle and the front wheels are larger than the rear wheels.

5. The riding device of claim 3 with a handrail connected with the frame wherein the handrail comprises a front grasping surface, and a left side grasping surface, a right side grasping surface.

6. The riding device of claim 3 further comprising a removeable push/pull handle assembly connected to a rear frame angled member wherein a joint allows the handle to rotate forward over the deck.

7. The handle assembly of claim 6 further comprising a tang with a cross bore, a handgrip, and a shaft wherein the tang is disposed within a slot in the rear frame angle member, wherein a quick release pin passes through the tang cross bore and a cross bore in the rear frame angle member to removeably connect the handle assembly to the frame.

8. The riding device of claim 3 further comprising a removeable push/pull handle assembly connected to a rear frame angled member wherein the handle assembly rotates up or down.

9. The riding device of claim 3, wherein each first rigid body further comprises the hanger assembly and the cylindrical bearing wherein each cylindrical bearing moveably rotates within the each baseblock along the hanger pivot axis coincident with the angle of the angled frame member creating a revolute joint that rotates around the hanger pivot axis, the cylindrical bearing comprising the cylindrical surface, the first pass through bore disposed within a first flat surface, the second pass through bore disposed within a second flat surface, and the length coincident with the revolute joint and the hanger pivot axis, the hanger assembly comprising a hanger with a horizontal member surrounding an axle that rotates around a hanger axle axis, and two laterally spaced wheels connected to the axle, the hanger assembly further comprising a projecting member with a first recessed area with a first side surface and a first threaded kingpin protruding from the first recessed area, and a second recessed area with a second side surface and a second threaded kingpin protruding from the the bottom surface of each baseblock further comprises a first recessed area with a first side surface and the first oval bore with a length disposed within the first recessed area, and a second recessed area with a second side surface and the second oval bore with a length disposed within the second recessed area, and at least one access hole in the top surface, two elastomeric bushings sandwiched between the projecting member of each hanger and the bottom surface of each baseblock, a first elastomeric bushing with a first bushing bore, wherein the first recessed area and first side surface of the projecting member receive and constrain a first bottom surface and a first lower portion of the side surface of the first elastomeric bushing, and the first recessed area and first side surface of the baseblock receive and constrain a first top surface and a first top portion of the side surface of the first elastomeric bushing, a second elastomeric bushing with a second bushing bore, wherein the second recessed area and second side surface of the projecting member receive and constrain a second bottom surface and a second bottom portion of the side surface of the second elastomeric bushing, and the second recessed area and second side surface of the baseblock receive and constrain a second top surface and a second top portion of the side surface of the second elastomeric bushing, wherein the first bushing bore receives the first kingpin and the second bushing bore receives the second kingpin;

wherein the length of the oval bores defines the degree of rotation of the cylindrical bearing relative to the baseblock, thereby defining the degree of rotation of the first rigid body around a hanger pivot axis relative to the second rigid body.

10. A riding device with a longitudinal roll axis, comprised of a front truck and a rear truck, each truck comprised of two rigid bodies and two elastomeric bushings, a first rigid body of each truck comprising a frame, an angled member at an angle to the frame, and a baseblock secured within the angled member, the baseblock comprising a top surface, bottom surface, front surface, and back surface, the bottom surface comprising a first recessed area with a first side surface and a first pass through bore disposed within the first recessed area, and a second recessed area with a second side surface and a second pass through bore disposed within the second recessed area, a first access hole and a second access hole in the top surface, a second rigid body of each truck comprising a hanger assembly with two threaded kingpins wherein each threaded kingpin is connected with a spherical bearing, the hanger assembly comprising a hanger with an axle that rotates around a hanger axle axis, and two laterally spaced wheels connected to the axle, the hanger assembly further comprising a projecting member with a first recessed area with hole and a first side surface with a first threaded kingpin threaded into the hole and protruding from the first recessed area, and a second recessed area with hole and a second side surface and a second threaded kingpin threaded into the hole and protruding from the second recessed area, wherein a first spherical bearing of the first kingpin moveably mates with a first bearing surface of the baseblock, and a second spherical bearing of the second kingpin moveably mates with a second bearing surface of the baseblock, and the spherical bearings rotate around a hanger pivot axis, two elastomeric bushings sandwiched between the projecting member of the hanger and the bottom surface of the baseblock, a first elastomeric bushing of each truck comprising a first bushing bore, wherein the first recessed area and first side surface of the projecting member receive and constrain a first bottom surface and a first lower portion of the side surface of the first elastomeric bushing, and the first recessed area and first side surface of the baseblock receive and constrain a first top surface and a first top portion of the side surface of the first elastomeric bushing, a second elastomeric bushing of each truck comprising a second bushing bore, wherein the second recessed area and second side surface of the projecting member receive and constrain a second bottom surface and a second bottom portion of the side surface of the second elastomeric bushing, and the second recessed area and second side surface of the baseblock receive and constrain a second top surface and a second top portion of the side surface of the second elastomeric bushing, wherein the first bushing bore of each truck receives the first kingpin and the second bushing bore of each truck receives the second kingpin, the front truck further comprising a front virtual pivot point at the intersection of a line projecting upward from a central point of a front hanger axle axis and a front hanger pivot axis, the rear truck further comprising a rear virtual pivot point at the intersection of a line projecting upward from a central point of a rear hanger axle axis and a rear hanger pivot axis, a longitudinal roll axis between the front virtual pivot point and the rear virtual pivot point.

11. A riding device comprising, a front truck and a rear truck, each truck comprising two rigid bodies and two elastomeric bushings, wherein in each truck a first rigid body is comprised of a hanger assembly with two kingpins, and a second rigid body is comprised of a frame connected with a baseblock, wherein a revolute joint moveably connects the first rigid body and the second rigid body, the front truck hanger assembly further comprising a front axle that is coincident with a front axle axis, the rear truck hanger assembly further comprising a rear axle that is coincident with a rear axle axis, the frame further comprising a front angled member at an angle that is coincident with a front hanger pivot axis, a center frame member, and a rear angled member at an angle that is coincident with a rear hanger pivot axis, a front virtual pivot point located at the intersection of a line projecting upward from a central point of the front hanger axle axis and the front hanger pivot axis, a rear virtual pivot point located at the intersection of a line projecting upward from a central point of the rear hanger axle axis and the rear hanger pivot axis, a longitudinal roll axis coincident with a virtual line between the front and rear virtual pivot points.

12. The riding device of claim 11 wherein the first rigid body of each truck further comprises a cylindrical bearing, the second rigid body of each truck further comprises a baseblock with a central bore and two oval bores each with a length in a bottom surface of the baseblock, wherein the cylindrical bearing is moveably disposed within the central bore forming the revolute joint, and wherein a first kingpin passes through a first oval bore and securely connects with the cylindrical bearing, and a second kingpin passes through a second oval bore and securely connects with the cylindrical bearing, and a length of the oval bores defines the degree of rotation of the cylindrical bearing round the hanger pivot axis.

13. The riding device of claim 11 wherein the first rigid body of each truck further comprises a first hemispheric bearing securely connected with a first kingpin and a second hemispheric bearing securely connected with a second kingpin, and the second rigid body of each truck further comprises a baseblock with a first pass through bore and a second pass through bore, wherein the first hemispheric bearing moveably connects with a first bearing surface in the first pass through bore, and the second hemispheric bearing moveably connects with the second bearing surface in the second pass through bore forming a functional revolute joint, and the hemispheric bearings rotate around the hanger pivot axis.

14. The riding device of claim 11 wherein the first rigid body of each truck further comprises a first threaded kingpin with a spherical head and a second threaded kingpin with a spherical head, and the second rigid body of each truck further comprises a baseblock with a first pass through bore and a second pass through bore, and wherein the first spherical head moveably connects with a first bearing surface in the first pass through bore, and the second spherical head moveably connects with the second bearing surface in the second pass through bore forming a functional revolute joint, and the spherical bearing heads rotate around the hanger pivot axis.

15. The riding device of claim 11 with a push/pull handle with a swivel yoke and universal swivel assembly to removeable connect with a rear angle frame member.

* * * * *